United States Patent [19]

Hunt et al.

[11] 4,434,931

[45] Mar. 6, 1984

[54] CASH BOX FOR PAPER CURRENCY

[75] Inventors: James W. Hunt; Raymond A. Johnson, both of Hot Springs, Ark.

[73] Assignee: UMC Industries, Inc., Stamford, Conn.

[21] Appl. No.: 320,767

[22] Filed: Nov. 12, 1981

[51] Int. Cl.[3] ..... G07F 9/06

[52] U.S. Cl. ..... 232/15; 232/1 R; 232/31; 312/215

[58] Field of Search ..... 232/15, 43.2, 1 R, 16, 232/31, 32; 312/215

[56] References Cited

U.S. PATENT DOCUMENTS

| | | | |
|---|---|---|---|
| 1,058,602 | 4/1913 | Kohler | 232/15 |
| 1,068,783 | 7/1913 | Kohler | 232/15 |
| 1,105,620 | 8/1914 | Cook | 232/15 |
| 1,105,621 | 8/1914 | Cook | 232/15 |
| 3,016,185 | 1/1962 | Osborne | 232/15 |
| 3,292,849 | 12/1966 | Ewing | 232/15 |
| 3,741,464 | 6/1973 | Verbeke | 232/15 |
| 3,773,252 | 11/1973 | Jensen | 232/15 |
| 3,843,043 | 10/1974 | Sciortino | 232/15 |
| 4,186,977 | 2/1980 | Gilouich et al. | 232/15 |

*Primary Examiner*—Gene Mancene
*Assistant Examiner*—James Hakomaki
*Attorney, Agent, or Firm*—Senniger, Powers, Leavitt and Roedel

[57] ABSTRACT

A cash box for paper currency has an opening therein through which a bill can be introduced into that cash box to form part of a stack of paper currency within that cash box. A closure is movable away from that opening to an open position to permit a bill to be introduced through that opening and stacked; and that closure is movable to a closed position adjacent that opening to prevent the removal of paper currency from that stack of paper currency. A latch for the closure permits the closure to be moved between the open and the closed positions; and the latch will, whenever that closure has been moved to open position and then to closed position, thereafter automatically prevent unauthorized movement of that closure out of closed position.

7 Claims, 30 Drawing Figures

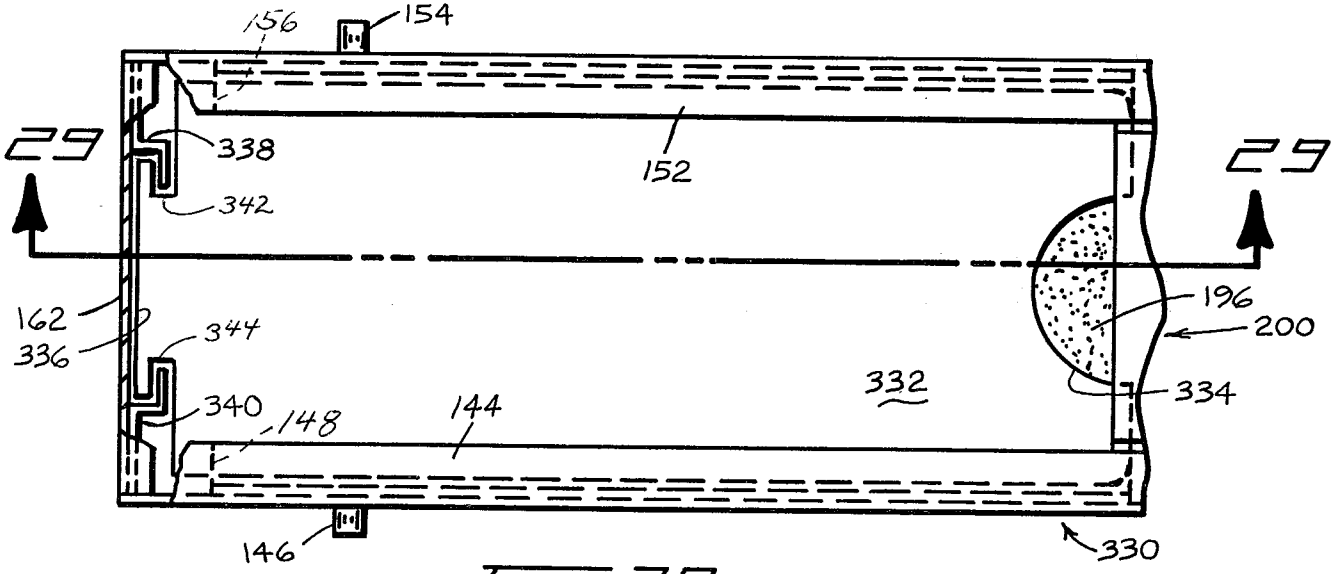
Fig. 28.
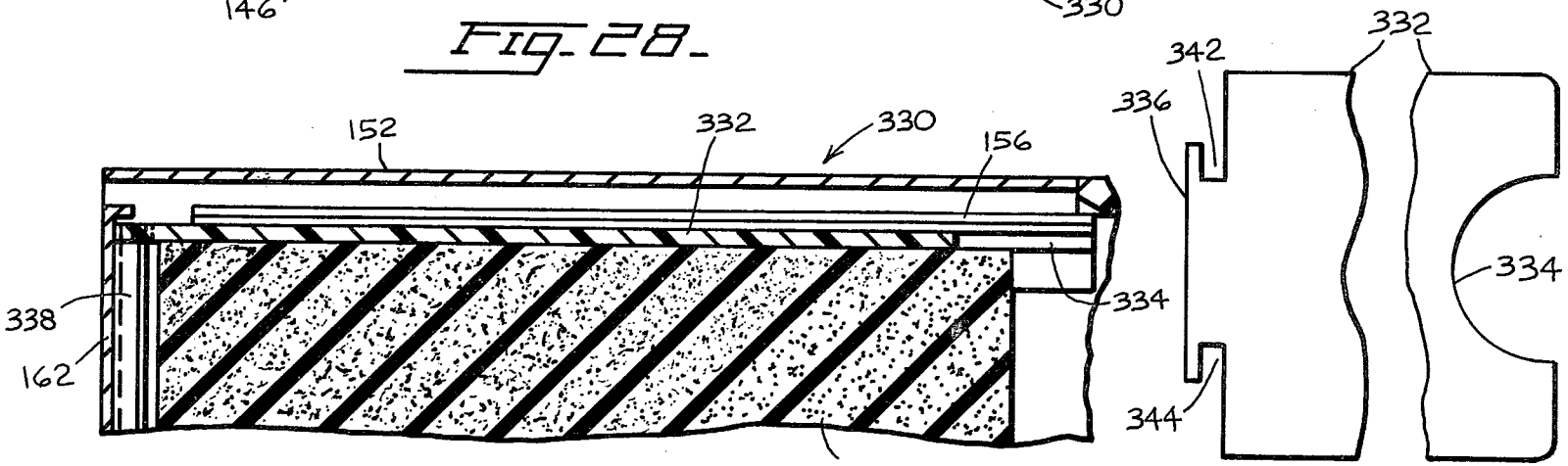
Fig. 30.
Fig. 29.

CASH BOX FOR PAPER CURRENCY

BACKGROUND OF THE INVENTION

It is desirable to store paper currency in the form of a stack; because stacked paper currency requires far less space than does an equal amount of paper currency which is not stacked. Further, stacked paper currency is easier to count and to handle than is currency which is not stacked. Consequently, where large numbers of bills are collected, it is desirable to incorporate those bills into a stack of paper currency.

Whenever large numbers of bills are stored or transported, they should be confined within a container which is locked against unauthorized opening. Also, those bills should be stored within that container in the form of a stack of paper currency.

SUMMARY OF THE INVENTION

A cash box for paper currency has an opening therein through which a bill can be introduced into the cash box to form part of a stack of paper currency within that cash box. A closure for that cash box is movable away from that opening to an open position to permit a bill to be introduced through that opening and stacked. That closure also is movable to a closed position adjacent that opening to prevent the removal of paper currency from that stack of paper currency. Latching means for the closure permit that closure to be moved between its open position and its closed position. That latching means will, after that closure has been moved to its open position and then to its closed position, thereafter automatically prevent movement of that closure out of its closed position. It is, therefore, an object of the present invention to provide a cash box with an opening therein through which paper currency can be introduced into that cash box to form part of a stack of paper currency within that cash box, to provide that cash box with a closure that can be moved away from that opening to an open position or adjacent that opening to a closed position, and to provide that cash box with a latching means that will, whenever that closure has been moved to open position and then to closed position, thereafter automatically prevent unauthorized movement of that closure out of closed position.

The cash box provided by the present invention is held adjacent a bill-accepting unit in a protective enclosure whenever paper currency is to be introduced into that cash box to be stacked. Whenever the closure of the cash box is in its open position, it will coact with adjacent portions of the bill-accepting unit to prevent separation of that cash box from that bill-accepting unit. Consequently, to remove the cash box from the bill-accepting unit, the closure of that cash box must be moved from its open position to its closed position; and, as that closure is moved toward its closed position, the latching means will automatically assume positions wherein they will lock that closure against unauthorized movement out of its open position. As a result, the cash box of the present invention must have the closure thereof set in closed position when that cash box is to be separated from the bill-accepting unit. It is, therefore, an object of the present invention to provide a cash box for stacked paper currency which has a closure that prevents separation of that cash box from a bill-accepting unit whenever that closure is in its open position and that must be moved to, and locked in, its closed position whenever that cash box is to be separated from that bill-accepting unit.

The closure for the cash box provided by the present invention has at least two sections; and one of those sections can be moved downwardly adjacent one wall of the cash box after that closure has been moved to its open position. The downward movement of that section is desirable; because it reduces the dimensions of the protective enclosure in which that cash box is held whenever it accepts paper currency. Both sections of the closure have confining surfaces thereon which will be confined by complementary confining surfaces on the cash box whenever that closure is in its closed position; but the confining surfaces on the one section of the closure can be moved wholly out of engagement with the complementary confining surfaces on the cash box. As a result, both sections of the closure are confined whenever the closure is in its closed position, but the one section is movable downwardly adjacent one wall of the cash box after that closure has been moved to its open position. It is, therefore, an object of the present invention to provide a plural-section closure for a cash box which has confining surfaces on all sections thereof that are held by complementary confining surfaces on that cash box whenever that closure is in its closed position, but which has the confining surfaces on one section thereof that are movable beyond those complementary confining surfaces to permit that one section to be moved downwardly close to a wall of that cash box whenever that closure is in its open position.

The latching means provided by the present invention include a rotatable latch which is initially positioned to permit movement of the closure from a position adjacent its closed position to its open position. As that closure is moved into its open position, the latch will automatically rotate to a position wherein it can permit movement of the closure from its open position to its closed position but will thereafter prevent unauthorized movement of that closure out of its closed position. It is, therefore, an object of the present invention to provide a locking means which includes a latch that is initially in a position wherein it can permit a closure to be moved from a position close to its closed position to its open position, that automatically rotates to a different position as that closure is moved into its open position, and that thereafter permits that closure to be moved to its closed position but will prevent all subsequent unauthorized movement of that closure out of its closed position.

The latch can be released when an authorized person unlocks a member which normally limits movement of the closure in the closing direction beyond its closed position. When that member is unlocked by that authorized person, the closure can be moved far enough in the closing direction beyond its closed position to permit the latch to resume its initial position. Thereupon, that closure can be moved away from its closed position to its open position. It is, therefore, an object of the present invention to provide a member which normally holds the closure against movement in the closing direction beyond its closed position but which can be unlocked to permit that closure to be moved in that direction beyond that position so that a latch can move to a position wherein it will permit the closure to be moved to its open position.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing, FIG. 28 is a partially-broken plan view, on the scale of FIG. 8, of another preferred form of cash box that is made in accordance with the principles and teachings of the present invention, FIG. 29 is a sectional view, on the scale of FIG. 8, which is taken along the plane indicated by the line 29—29 in FIG. 28, and FIG. 30 is a broken view of the bill-supporting plate of the cash box of FIGS. 28 and 29.

DETAILED DESCRIPTION OF PREFERRED EMBODIMENT

Figure 1:
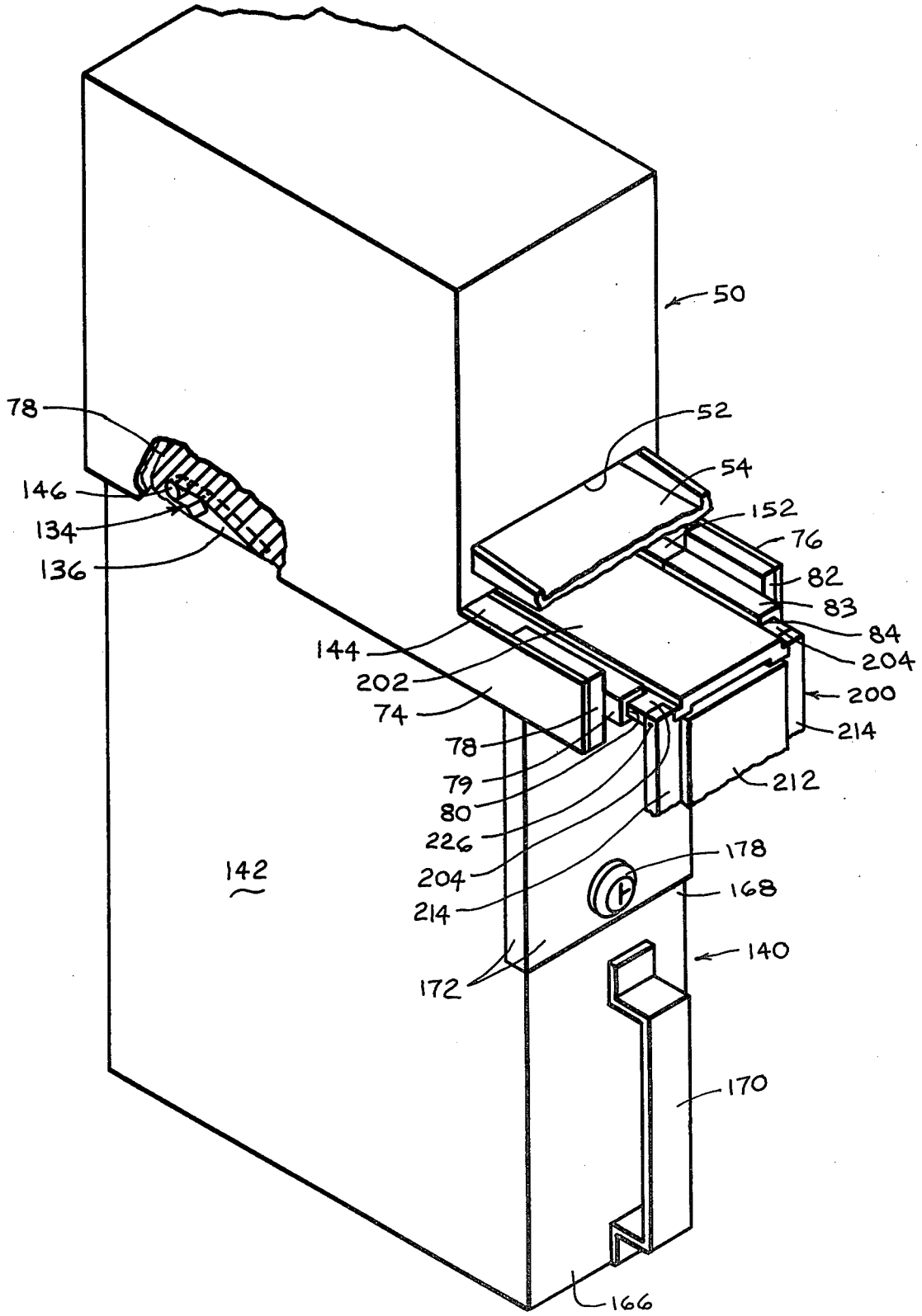
FIG. 1 is a partially broken-away perspective view of a bill-accepting unit and of a paper currency cash box which is suspended from that bill-accepting unit.
Figure 3:
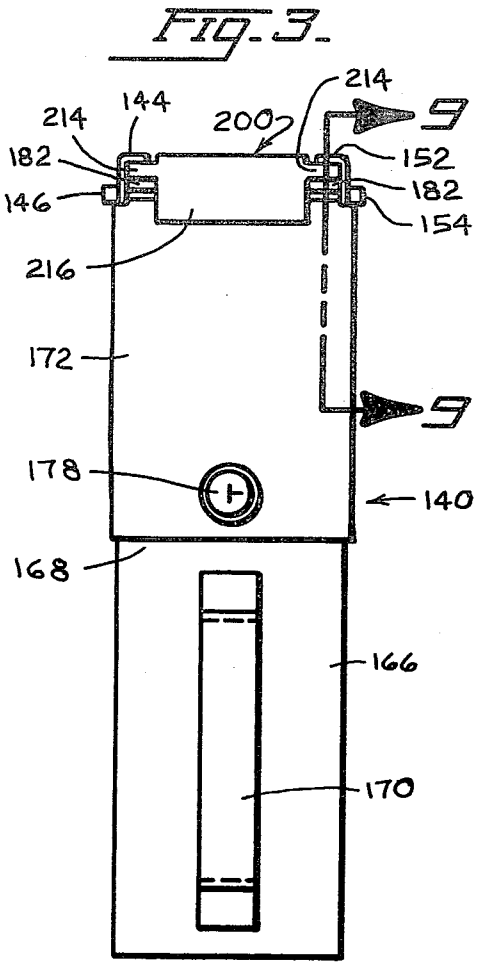
FIG. 3 is a front elevational view of the cash box of FIGS. 1 and 2.

Bill-Accepting Unit:

Referring particularly to FIGS. 1 and 24–26, the numeral 50 generally denotes a bill-accepting unit with which the paper currency cash box 140 of the present invention can be used. A horizontal slot 52 is provided in the front of the housing for that bill-accepting unit; and a bill-receiving platform 54 is mounted adjacent the lower edge of that slot. That platform has the leading edge thereof extending outwardly from the front of the housing for the bill-accepting unit 50; and that platform has upstanding sides to help position a bill on that platform. A trailing edge of platform 54 inclines downwardly from a plane which is defined by that platform, as shown particularly by FIG. 26. A plate 55 inclines downwardly and inwardly at a shallow angle, and then extends horizontally inwardly, from the upper edge of the slot 52, as shown particularly by FIG. 26. That plate is spaced a sufficient distance above the platform 54 to readily accommodate a dollar bill or any other suitable form of paper currency.

The bill-accepting unit 50 will normally be held in fixed position within the upper portion of a protective enclosure, not shown. A horizontal slot in the front of that protective enclosure will permit the platform 54 to project forwardly through it; and, when that platform is projecting from the slot, the front wall of the bill-accepting unit 50 will be close to the inner surface of the front of that protective enclosure. A cup-shaped door is preferably mounted below the level of platform 54; and that door will define a space which is disposed forwardly of the front wall of the housing of the bill-accepting unit 50. A lock will normally hold that cup-shaped door in closed position to prevent access to the interior of the protective enclosure. However, that lock can be actuated by a key to free the cup-shaped door for movement to an open position. The protective enclosure is not, per se, a part of the present invention, and hence is not shown by the drawing.

The platform 54 has two small openings therein; and a light-emitting diode 56 is disposed below, and in register with, one of those openings, while a light-emitting diode 58 is disposed below, and in register with, the other of those openings. The plate 55 has two small openings therein which are above, and in register with, the two small openings in the platform 54. A phototransistor 60 is located above, and in register with, the opening above LED 58; and a phototransistor 62 is located above, and in register with, the opening above LED 56. Prior to the time a bill 130 is placed on the platform 54 and moved into the slot 52, the light from LED 56 will reach the phototransistor 62 and render it conductive, and the light from LED 58 will reach the phototransistor 60 and render it conductive.

The numeral 64 denotes two rollers which are mounted on a rotatable shaft 66 that is held by bearings, of standard and usual design, which are supported by the sidewalls of the housing for the bill-accepting unit 50. Those rollers have surfaces of rubber, synthetic rubber, soft plastic or the like which provide high values of frictional force. The lower portions of those rollers extend downwardly through generally-rectangular openings 57 in the plate 55. A gear 68 is mounted on the shaft 66, so rotation of that gear will effect rotation of the rollers 64. The numeral 70 denotes two rollers which are mounted on a rotatable shaft 72 that is held by bearings, of standard and usual design, which are supported by the sidewalls of the housing for the bill-accepting unit 50. The rollers 70 are similar to the rollers 64; and the upper portions of rollers 70 extend upwardly through openings in the rear of platform 54 to normally engage the lower surfaces of rollers 64. The surfaces of rollers 64 and 70 can yield to accommodate bills which are placed on the platform 54 and have their leading edges moved into engagement with the abutting surfaces of those rollers.

Figures 24, 25:
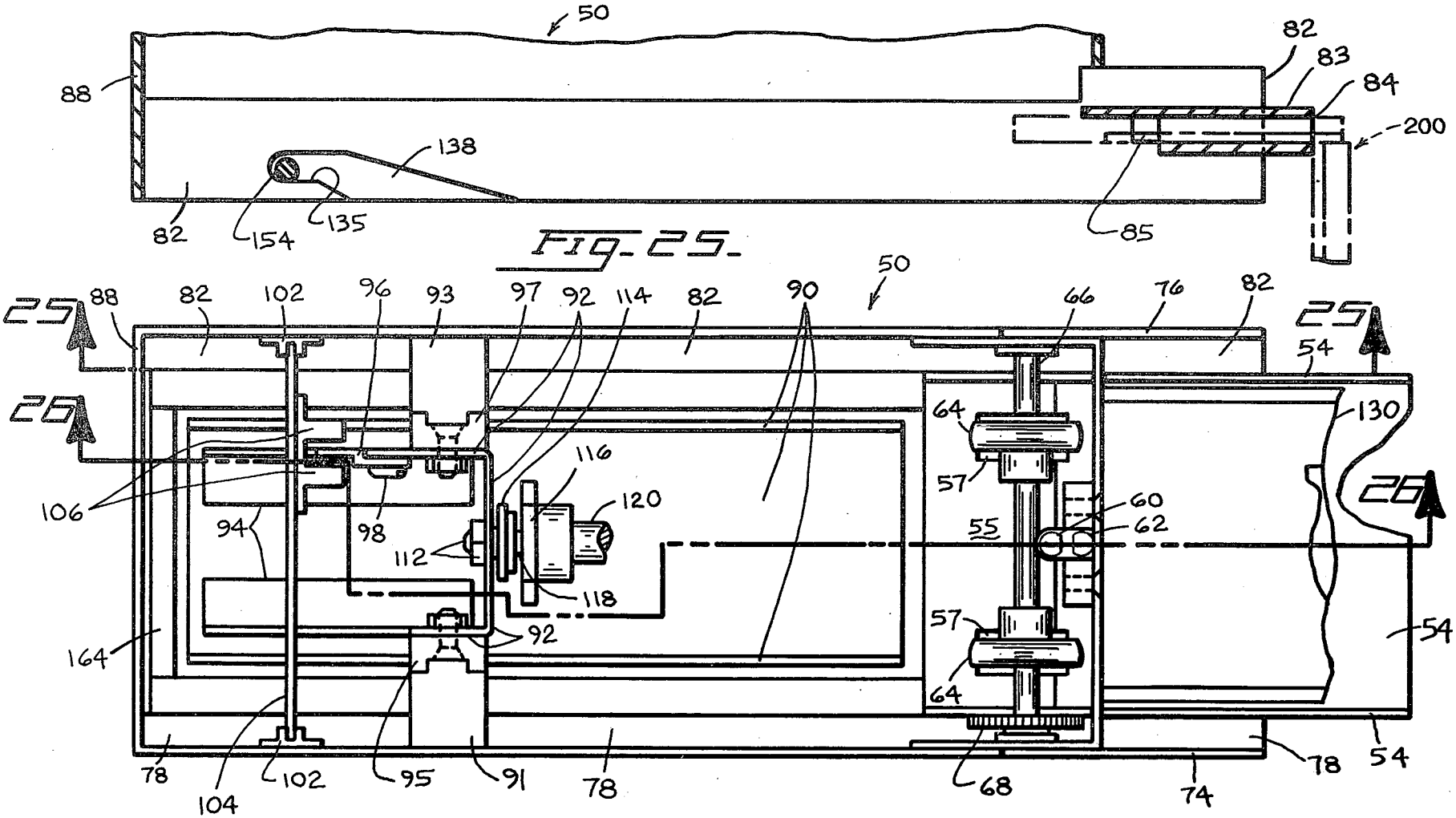
FIG. 24 is a partially broken-away plan view, on the scale of FIG. 8, of the bill-accepting unit of FIG. 1.
FIG. 25 is a sectional view, on the scale of FIG. 8, which is taken along the plane indicated by the line 25—25 in FIG. 24.

The numeral 74 denotes a horizontally-directed projection at the front of the left-hand wall of the housing for the bill-accepting unit 50. A similar horizontally-directed projection 76 is provided at the front of the right-hand wall of that housing. The numeral 78 denotes a horizontally-directed elongated block which is fixedly secured to the inner faces of the left-hand wall and of the projection 74 thereon. That elongated block has a channel-like portion or channel 79 at the front of the inner face thereof; and an elongated horizontally-directed slot 80 is formed in the inner face of that channel-like portion. The numeral 82 denotes a horizontally-directed elongated block which is fixedly secured to the inner faces of the right-hand wall and of the projection 76 thereon. That elongated block has a channel-like portion or channel 83 at the front of the inner face thereof; and an elongated horizontally-directed slot 84 is formed in the inner face of that channel-like portion. The elongated block 82, the channel-like portion 83, and the slot 84 are, respectively, at the same level as, and in register with, the elongated block 78, the channel-like portion 79, and the slot 80. The inner end of the lower part of the portion 83 is denoted by the numeral 86; and that inner end is located a short distance outwardly of the front wall of the housing of the bill-accepting unit 50, as shown particularly by FIG. 26. A chamfered surface 85, which is shown in FIG. 25, inclines outwardly and rearwardly from the inner face of slot 84 to the inner face of block 82. The inner end, not shown, of the lower portion of the channel-like portion 79 of the block 78 is in register with the inner end 86, and hence also is located a short distance outwardly of the front wall of the housing of the bill-accepting unit 50. A chamfered surface, not shown, like the chamfered surface 85, inclines outwardly and rearwardly from the inner face of slot 80 to the inner face of block 78.

Figure 26:
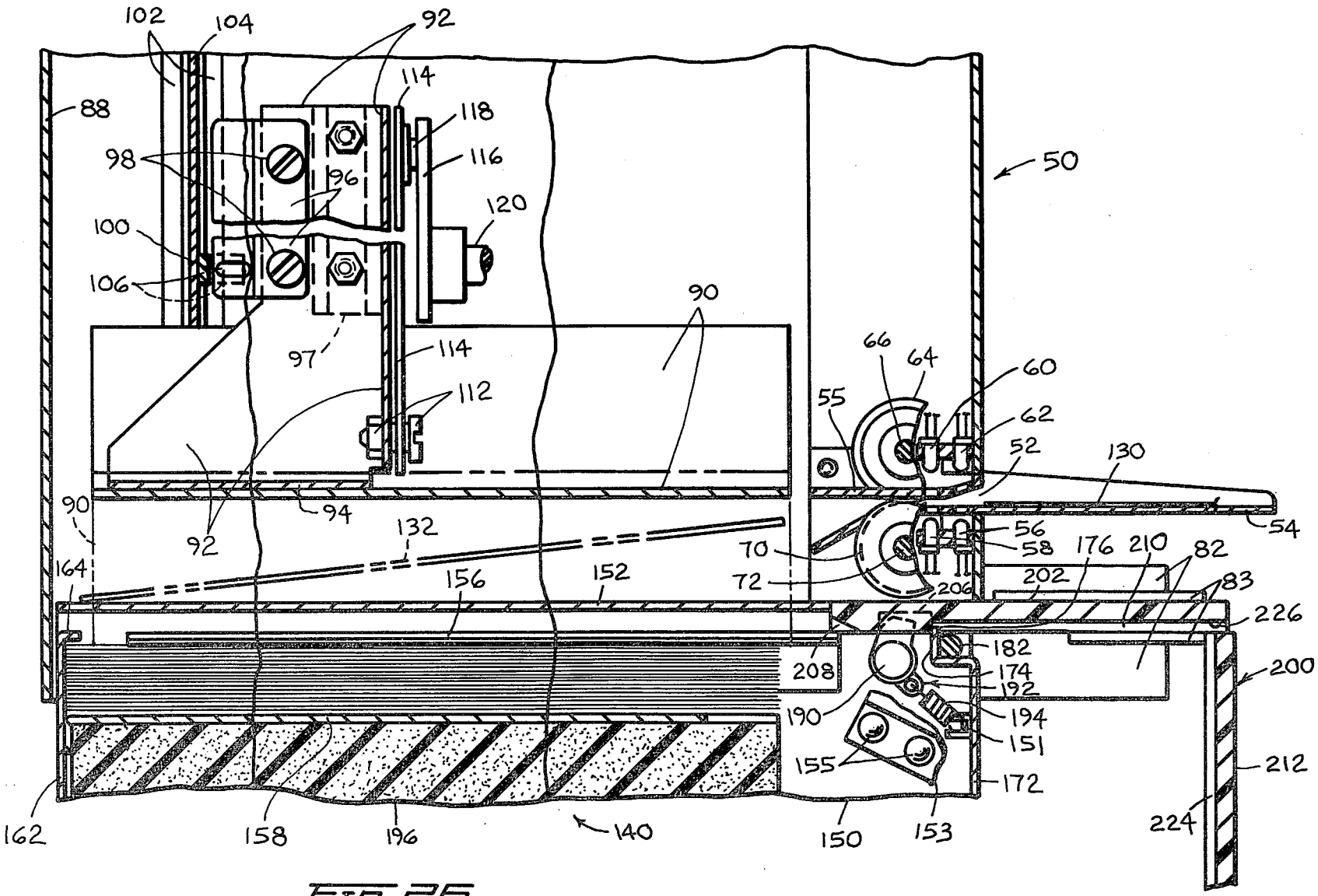
FIG. 26 is a partially-broken sectional view on the scale of FIG. 8, through the bill-accepting unit and cash box of FIG. 1, and it is taken along the broken plane indicated by the broken line 26—26 in FIG. 24.

The numeral 88 denotes the rear wall of the housing of the bill-accepting unit 50; and that rear wall is shown in FIGS. 24–26. The rear of the elongated block 78 is adjacent that rear wall; and the rear end of the elongated block 82 is adjacent that rear wall. The lower faces of those elongated blocks coact with the lower edges of the side and rear walls of the housing of the bill-accepting unit 50 to define a horizontal plane. The inner faces of the elongated blocks 78 and 82 coact with the inner face of the rear wall to define a space that will accommodate the top of the cash box 140.

The elongated block 78 has a horizontally-directed notch 134 therein adjacent the rear end thereof, as shown particularly by FIG. 1; and the elongated block 82 has a similar notch 135 therein adjacent the rear end thereof. The notches 134 and 135 are at the same level and are in register with each other. An enlarged entrance 136 is provided in the bottom of the elongated block 78 for the notch 134, as shown particularly by FIG. 1. A similar enlarged entrance 138 is provided in the bottom of the elongated block 82 for the notch 135, as shown particularly by FIG. 25.

The numeral 90 denotes a pusher plate which has upstanding sides to make it U-shaped in end view. As shown particularly by FIG. 24, the long axis of that pusher plate is parallel to the sidewalls of the housing of the bill-accepting unit 50. The width of the pusher plate 90 is substantially smaller than the space between the confronting surfaces of the elongated blocks 78 and 82. A bracket 92 is U-shaped in plan view, as shown particularly by FIG. 24; and it has feet 94 which extend inwardly toward each other and which are fixedly secured to the upper face of the bottom of the pusher plate 90. That bracket is located adjacent the rear of the pusher plate 90, as shown by FIGS. 24 and 26. A vertically-directed guide block 91 is secured to the inner face of the left-hand wall of the housing of the bill-accepting unit 50; and a similar guide block 93 is secured to the inner face of the right-hand wall of that housing. A guide 95 is secured, by a screw and nut, to the outer face of one side of the bracket 92; and it engages, and is guided for vertical movement by, the guide block 91. A guide 97 is secured, by a screw and nut, to the outer face of the other side of the bracket 92; and it engages, and is guided for vertical movement by, the guide block 93. As a result, the guide blocks 91 and 93 and the guides 95 and 97 confine the pusher plate 90 for guided vertical movement in the space defined by the inner faces of elongated blocks 78 and 82 and of rear wall 88.

The numeral 96 denotes an offset plate which is vertically directed, as shown particularly by FIG. 26; and that plate is secured to one of the sides of the bracket 92, adjacent the vertically-directed rear edge of that side, by screws 98. A horizontally-directed slot 100 is provided in the plate 96 adjacent the lower left-hand corner of that plate, as shown by FIG. 26.

Supports 102 are secured to the inner faces of the sidewalls of the housing of the bill-accepting unit 50, as shown by FIG. 24. Those supports have vertically-directed slots therein which coact to hold a printed circuit board 104. A molded U-shaped housing 106 is secured to the right-hand face of that printed board, as that printed board is viewed in FIG. 24. A light-emitting diode 108 is mounted in one arm of that U-shaped housing, and a phototransistor 110 is mounted in the other arm of that housing. That LED and phototransistor are in the schematic diagram of FIG. 27. Whenever the pusher plate 90 is in the upper position shown by solid lines in FIG. 26, the slot 100 in the plate 96 will permit light from that LED to pass to that phototransistor. However, whenever that pusher plate is in the lower position indicated by dotted lines in FIG. 26, the plate 96 will keep light from LED 108 from reaching phototransistor 110.

Figure 27:
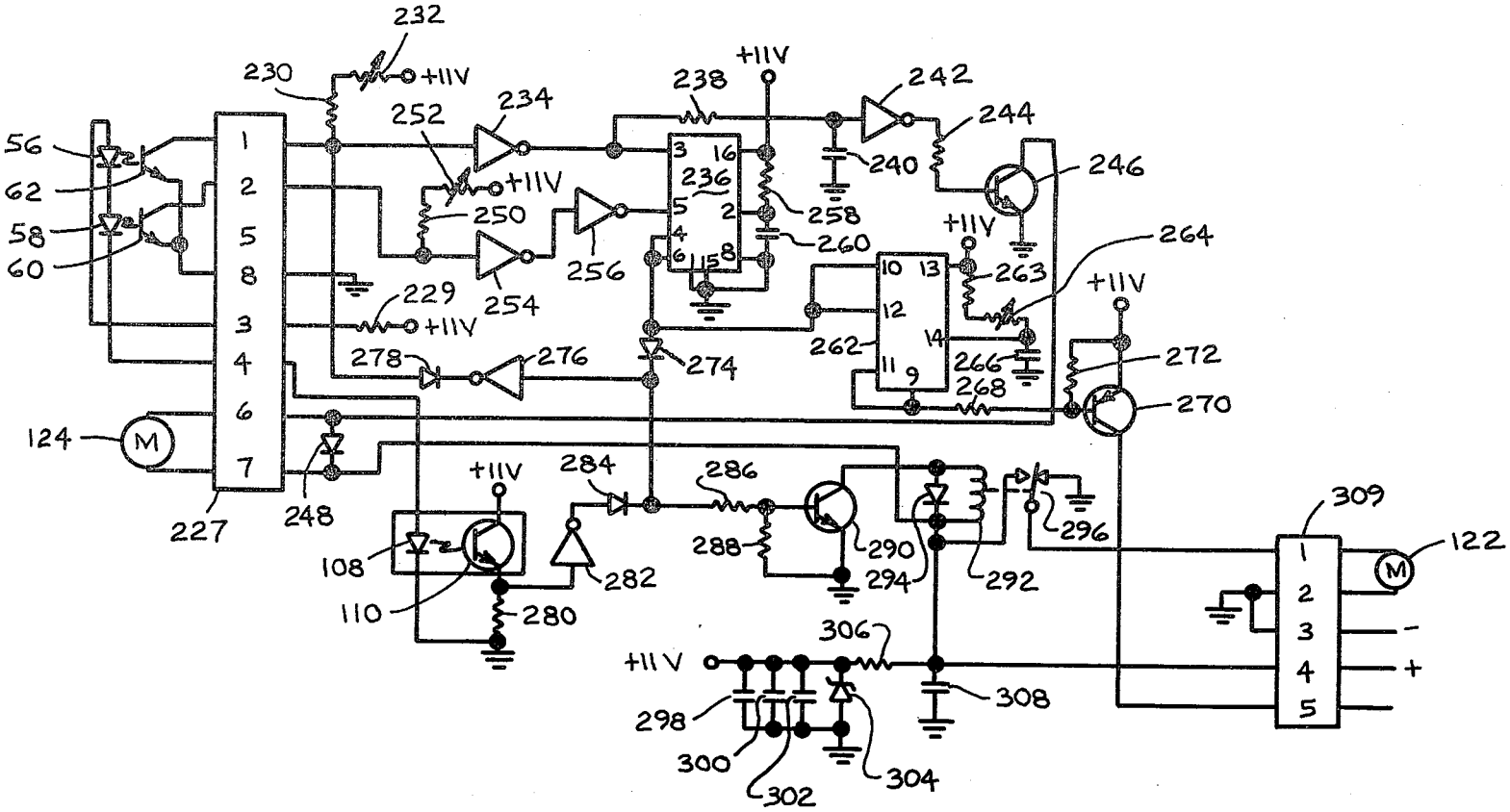
FIG. 27 is a schematic diagram of the circuit for the bill-accepting unit of FIG. 1.

The numeral 112 denotes a pivot which consists of a shouldered screw and a nut. That pivot secures the lower end of a connecting link 114 to the end wall of the U-shaped bracket 92, and hence to the pusher plate 90, while permitting rotation of that connecting link relative to that bracket and pusher plate. The numeral 116 denotes a crank arm which has the outer end thereof secured to the upper end of the connecting link 114 by a pin 118. That crank arm is mounted on a rotatable shaft 120 which is rotated by a stacker motor 122 that is shown at the right of FIG. 27. The numeral 124 denotes a bill-moving motor which is shown at the left of FIG. 27 and which drives the gear 68 of FIG. 24.

In the preferred embodiment of the present invention, the bill 130 is a U.S. one dollar bill. The numeral 132 denotes the path of that bill after the rollers 64 and 70 have drawn that bill inwardly through the slot 52 and directed it toward the rear wall 88 of the housing of the bill-accepting unit 50. That bill will be moving rapidly as it leaves the rollers 64 and 70—preferably at a rate of several inches per second—and hence will move toward the rear wall 88 along path 132 which is inclined downwardly at a shallow angle from upper right to lower left in FIG. 26.

Figure 6:
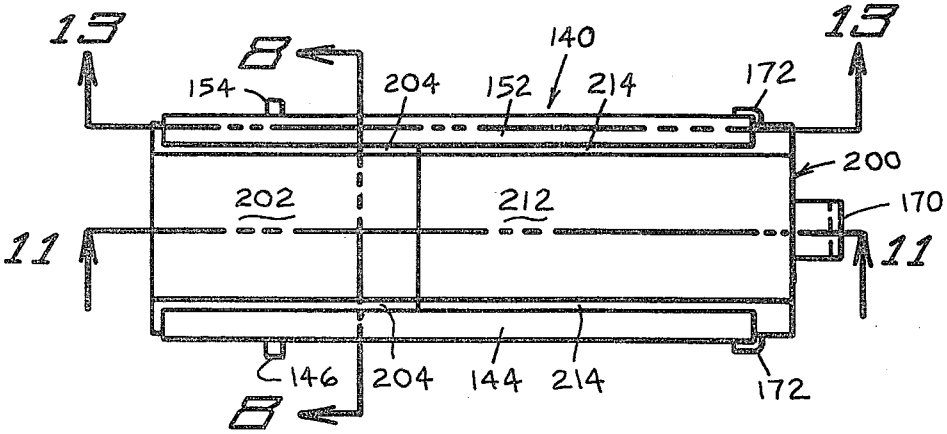
FIG. 6 is a plan view of the cash box of FIGS. 1–5 in its closed position.
Figure 7:
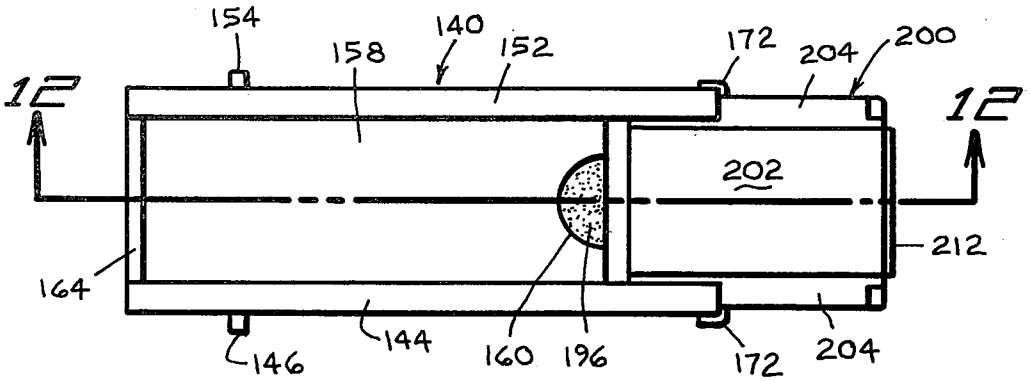
FIG. 7 is a plan view of the cash box of FIGS. 1–6 in its open position.
Figure 15:
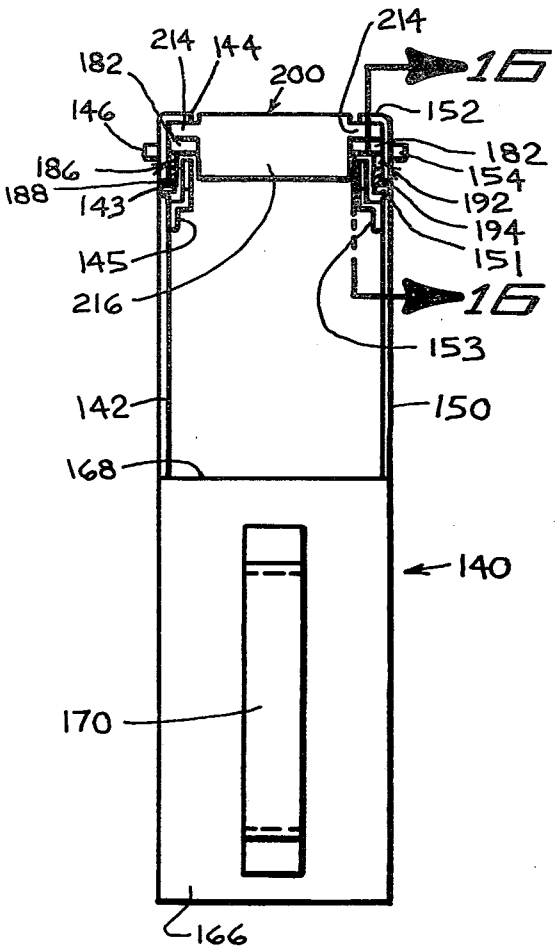
FIG. 15 is a front elevational view, on the scale of FIG. 2, which shows the cash box of FIGS. 1–14 after the door thereof has been removed.

Cash Box:

As shown by FIGS. 1–26, the cash box 140 is generally rectangular in plan and in elevation. The upper portion of the left-hand side wall 142 of that cash box has an inwardly-directed flange 144 which is shown particularly by FIGS. 6–8. An L-shaped ear 143, adjacent the front of that side wall, is defined by forming horizontally-directed notches above and below that ear and by bending the intervening metal inwardly to form that ear; and that ear is shown particularly by FIGS. 14 and 15. The numeral 145 denotes an offset bracket which is secured to the upper front area of the inner face of the sidewall. 142 by rivets 147, as shown particularly by FIGS. 14 and 15. A pin 146 extends outwardly from the upper rear portion of the side wall 142; and that pin is dimensioned to be moved upwardly through the entrance 136 into the slot 134 in the rear of the elongated block 78. The numeral 148 denotes an angle iron which is shown particularly by FIG. 8 and which is secured to the upper portion of the inner face of the side wall 142 of the cash box 140. The angle which is subtended by that angle iron is slightly less than ninety degrees; and that angle iron is spaced a short distance below the flange 144.

The numeral 150 denotes the right-hand side wall of the cash box 140; and the upper portion of that side wall has an inwardly-directed flange 152. As shown particularly by FIG. 8, that flange is coplanar with, and extends toward, the flange 144 on the upper portion of the side wall 142 of the cash box 140. A pin 154 is coaxial with the pin 146, it projects outwardly from the upper rear corner of side wall 150, and it will pass inwardly through the entrance 138 in elongated block 82 to lodge in the notch 135 in that block.

The numeral 151 denotes an ear adjacent the front of the side wall 150; and it is a mirror image of the ear 143 adjacent the front of the side wall 142. An offset bracket 153, which is a mirror image of the offset bracket 145, is secured to the upper front portion of the inner face of side wall 150 by rivets 155. The brackets 145 and 153 are in register with each other. The numeral 156 denotes an angle iron which is a mirror image of the angle iron 148 and which is secured to the upper front portion of the inner face of the side wall 150. The angle iron 156 is located a short distance below the level of the flange 152, as shown particularly by FIG. 8; and it is in register with, and at the same level as, the angle iron 148.

Figure 8:
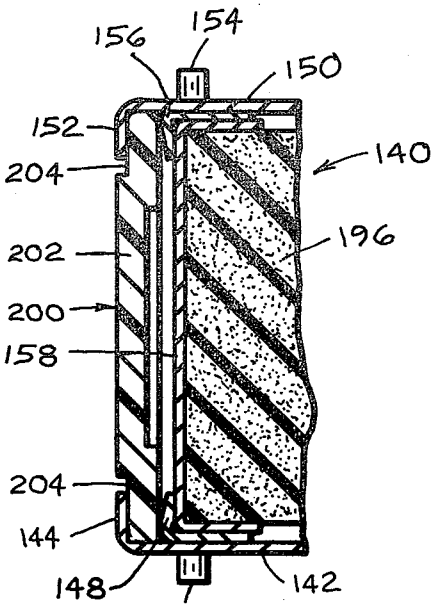
FIG. 8 is a sectional view, on a larger scale, which is taken along the plane indicated by the line 8—8 in FIG. 6.

The numeral 158 denotes a bill-supporting plate which has the configuration of an inverted U, as shown particularly by FIG. 8. An arcuate notch 160 is formed in the leading edge of the web of that bill-supporting plate, as shown particularly by FIG. 7; and that notch will accommodate the tip of the finger of a person who wishes to remove bills which are held in stacked array within the cash box 140.

The rear edge of the web of the bill-supporting plate 158 has a downwardly-turned flange; and that flange is immediately adjacent the rear wall 162 of cash box 140. The upper edge of that rear wall has a horizontally-directed flange 164 which overlies the rear edge of the bill-supporting plate 158.

The lower portion of the front of the cash box 140 is closed by a front wall 166; and the height of that front wall is about one-half of the height of that cash box. The upper edge of that front wall is denoted by the numeral 168. A handle 170 extends outwardly from the outer face of the front wall 166 of the cash box 140.

The numeral 172 denotes a door which normally overlies the upper portion of the front of cash box 140; and that door has flanges at the sides thereof which make that door U-shaped in plan. An inwardly-offset flange 174 is provided at the end of door 172 which is shown at the left in FIGS. 21 and 22. That end will be the top of the door 172 whenever that door is assembled with the cash box 140. A shallow but elongated abutment 176 constitutes an extension of the flange 174; and that abutment will project upwardly from the flange 174 whenever the door 172 is assembled with the cash box 140. A lock 178 is mounted in the opposite end of the door 172; and that lock has a rotatable locking blade 180. That locking blade is shown in its locking position in FIGS. 21 and 22; but that locking blade can be rotated ninety degrees to an unlocking position when a key is inserted in, and is used to actuate, the lock 178.

The numeral 182 denotes an elongated rod which has the opposite ends thereof fixedly held within aligned openings in the upper front portions of the side walls 142 and 150 of the cash box 140. That rod constitutes a stop against which the inwardly-offset flange 174 at the upper end of door 172 can bear whenever that door is locked in position to cover the upper portion of the front of the cash box 140, as indicated particularly by FIGS. 9–13 and 26. Whenever that inwardly-offset flange abuts the rod 182, the abutment 176 atop that flange extends upwardly above the level of the lower surfaces of the slots 80 and 84 in the confronting faces of the channel-like portions 79 and 83.

Figure 2:
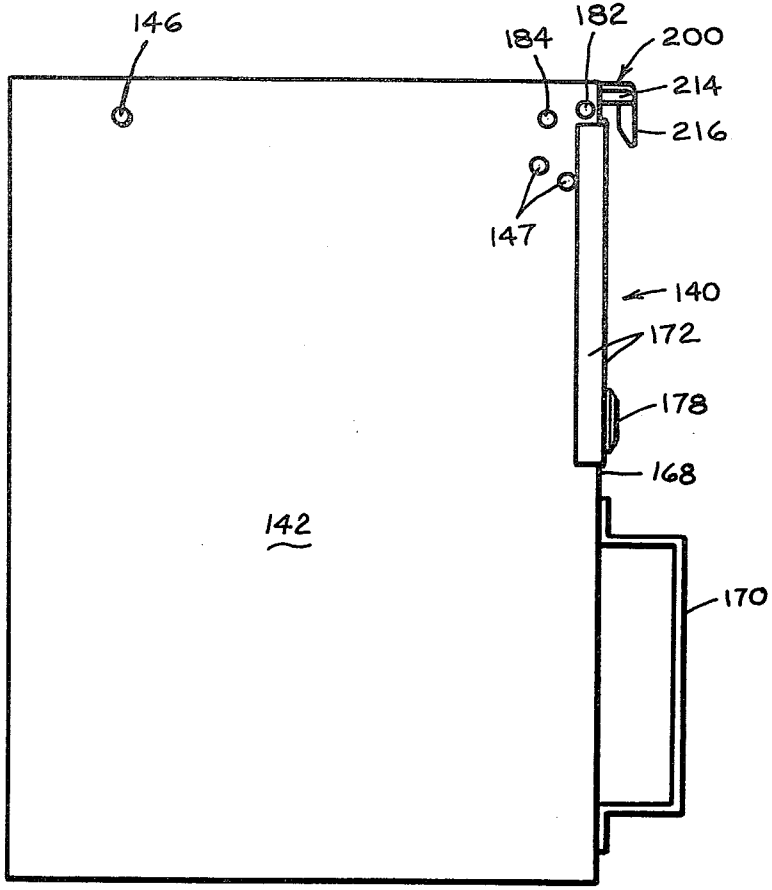
FIG. 2 is a side elevational view of the cash box of FIG. 1 prior to the time it is suspended from the bill-accepting unit.
Figure 5:
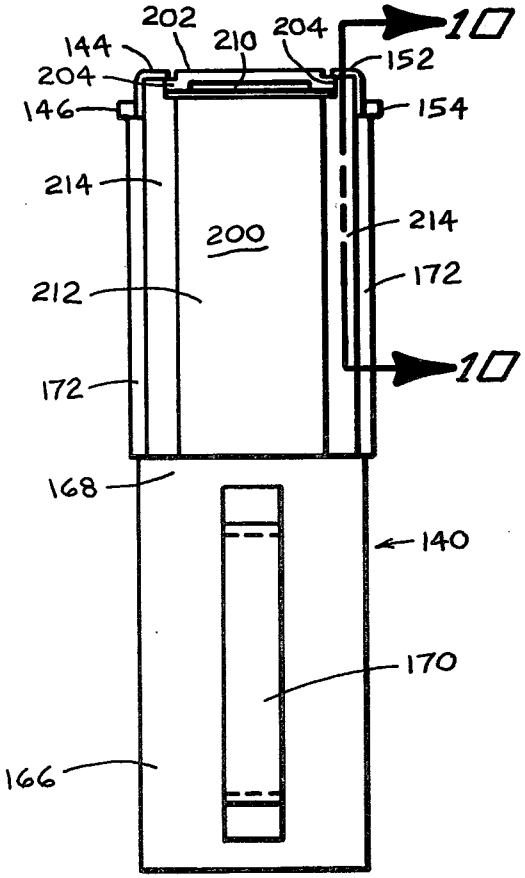
FIG. 5 is a front elevational view of the cash box of FIGS. 1–4 in its open position.
Figure 4:
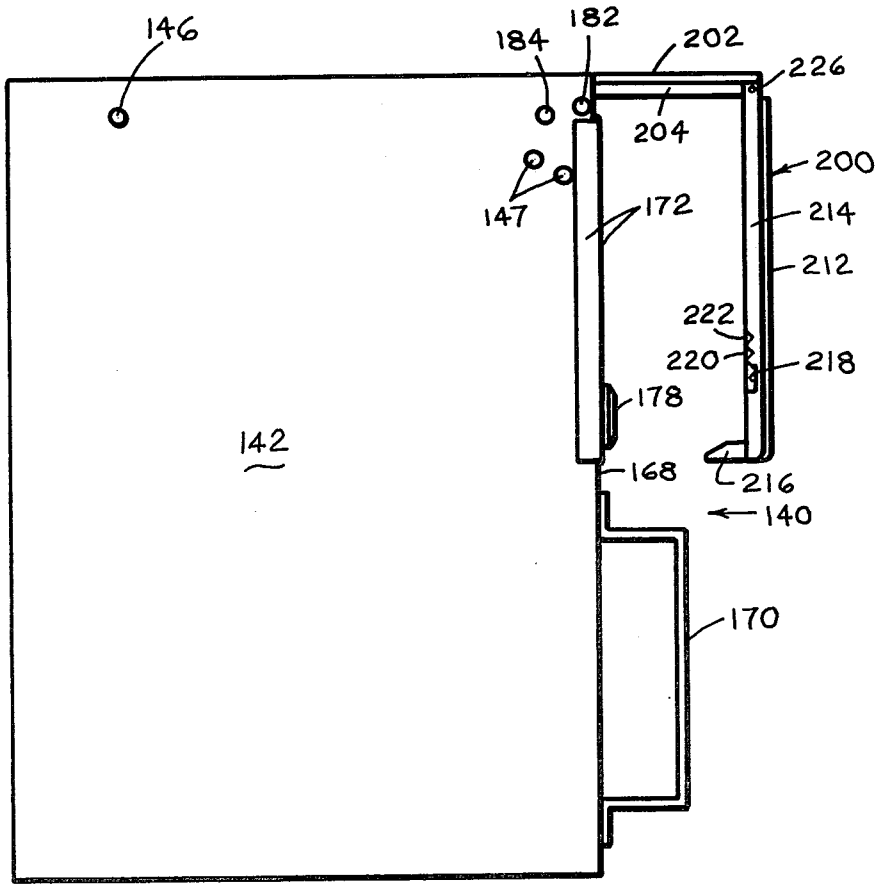
FIG. 4 is a side elevational view of the cash box of FIGS. 1–3 after the closure thereof has been moved to its open position.

The numeral 184 denotes a pivot that is fixedly secured to the upper front portion of the side wall 142 of cash box 140, as indicated particularly by FIGS. 2, 4 and 14. A latch 186 is rotatably supported on that pivot; and a helical extension spring 188 extends between the lower end of that latch and the ear 143. The numeral 190 denotes a pivot which is fixedly secured to the upper front portion of the side wall 150 of the cash box 140, as shown particularly by FIGS. 9–13, 16 and 26. The numeral 192 denotes a latch which is identical to the latch 186 and which is rotatably mounted on pivot 190. A helical extension spring 194 extends between the lower portion of latch 192 and the ear 151. A flat latching face 193 is provided on the latch 192; and a similar flat latching face, not shown, is provided on the latch 186. The spring 194 biases the latch 192 toward the position of FIG. 16, but that spring can yield to permit that latch to be rotated in either direction from that position. Similarly, spring 188 biases the latch 186 to a position which is identical to the position occupied by latch 192 in FIG. 16, but that spring can yield to permit latch 186 to be rotated in either direction from that position.

The numeral 196 denotes a block of resilient material which is rectangular in plan and in elevation. Although various materials could be used in making the block 196, a highly-flexible, highly-resilient foam-type plastic is preferred. The length and width of that block are very close to the length and width of the bill-supporting plate 158, as shown by FIGS. 9–13, 16 and 26. The unstressed height of that block is slightly greater than the overall height of the cash box 140. As a result, that block must be compressed to dispose it between the closed bottom of that cash box and the lower surface of the bill-supporting plate 158. That compression is desirable, because it enables restorative forces within that block to urge that bill-supporting plate upwardly toward the position shown by FIGS. 7–9, 11, 12 and 16 wherein the upper surface of that bill-supporting plate engages the lower surfaces of the generally-horizontal portions of the angle irons 148 and 156. That block is sufficiently resilient to permit bills to be stacked between the upper surface of the bill-supporting plate 158 and the lower surfaces of the horizontally-directed portions of the angle irons 148 and 156 until that bill-supporting plate is very close to the closed bottom of the cash box 140. As a result, even a bill-stacking cash box of only moderate height can accommodate a stack of bills which includes several hundred bills.

Closure for Cash Box:

Referring particularly to FIGS. 17–20, the numeral 200 generally denotes a closure for the cash box 140. That closure comprises slide plate means having a rear section 202 with reduced-height side edges 204 that are dimensioned to fit between the lower surfaces of the horizontally-directed flanges 144 and 152 and the upper surfaces of the angle irons 148 and 156 within the cash box 140. Those reduced-height side edges are dimensioned so the section 202 can slide freely relative to that cash box but can not be pulled or pried upwardly out of its position within the top of that cash box. Short recesses 206 are provided in the undersurfaces of the reduced-height side edges 204, as shown particularly by FIGS. 18 and 19; and those recesses are spaced short distances forwardly of the rear edge of section 202. A chamfered surface 208 is provided at the bottom edge of the inner end of section 202. The numeral 210 denotes a wide, but shallow, recess in the undersurface of the section 202; and that recess is slightly deeper than the height of the abutment 176 on the inwardly-offset flange 174 at the top of door 172.

The numeral 212 denotes the front section of closure 200; and that section has reduced-height side edges 214 which are similar to, but longer than, the reduced-height side edges 204 of section 202. The reduced-height side edges 214 also fit between the horizontally-directed flanges 144 and 152 and the horizontally-directed portions of the angle irons 148 and 156 within cash box 140. A finger-receiving tab 216 extends downwardly from the forward edge of section 212, as shown particularly by FIG. 18; and that tab can be pushed or pulled to move the closure 200 inwardly or outwardly relative to cash box 140. The numeral 218 denotes short recesses in the undersurface of the reduced-height side edges 214 of section 212. The numeral 220 denotes generally V-shaped notches which are in the undersurfaces of the reduced-height side edges 214 and which are disposed very short distances inwardly of the recesses 218. Further generally V-shaped notches 222 are formed in the lower surfaces of the reduced-height side edges 214 and are spaced very short distances inwardly of the notches 220. The numeral 224 denotes a wide, but shallow, recess in the undersurface of section 212 of closure 200. As shown particularly by FIGS. 19 and 20, that recess has the same width and the same depth as the recess 210 in the undersurface of section 202 of that closure. Two hinge pins 226 pivotally secure the sections 202 and 212 of closure 200 together. The confronting surfaces of the sections 202 and 212 fit closely enough whenever the closure 200 is in the closed position of FIGS. 9, 11, 13 and 16 to keep persons from passing objects downwardly through the joint between those sections. As a result, whenever that closure is in that closed position, no object can be inserted through, around, or underneath that closure to extract bills from the cash box 140.

Control Circuit:

Referring particularly to FIG. 27, the numeral 227 denotes an eight-pin connector of standard and usual design; and pin 1 of that connector interconnects the collector of phototransistor 62 with a resistor 230, the input of an inverter 234, and the anode of a diode 278. An adjustable resistor 232 connects resistor 230 to a regulated source of positive eleven volts D.C. A junction connects the output of inverter 234 to pin 3 of a monostable multivibrator 236, and, via a resistor 238, to the input of an inverter 242 and to the upper terminal of a capacitor 240 which has the lower terminal thereof grounded. A resistor 244 connects the output of inverter 242 to the base of an NPN transistor 246 which has the emitter thereof grounded. A junction connects the collector of that transistor to pin 6 of connector 227 and also to the anode of a diode 248. Pin 6 and pin 7 of that connector are connected to the terminals of bill-moving motor 124; and a junction connects pin 7 to the cathode of diode 248 and, via three additional junctions, to pin 4 of a five-pin connector 309 of standard and usual design. The positive terminal of a twelve volt battery, not shown, is connected to that pin; and the negative terminal of that battery is connected to ground by pin 3 of that connector.

The positive terminal of the twelve volt battery is connected to the upper terminal of a capacitor 308 by pin 4; and it is connected to a terminal 297, to the upper terminal of a Zener diode 304, and to the upper terminals of capacitors 298, 300 and 302 by a resistor 306. The lower terminals of capacitors 298, 300, 302 and 308 and of Zener diode 304 are grounded. Terminal 297 constitutes the source of positive regulated eleven volts D.C.

The numerals 252 and 250 denote, respectively, adjustable and fixed resistors which connect the positive regulated eleven volts D.C. to pin 2 of connector 227 and to the input of an inverter 254. The collector of phototransistor 60 is connected to that pin; and pin 8 of connector 227 connects the emitters of that phototransistor and of phototransistor 62 to ground. An inverter 256 connects the output of inverter 254 to pin 5 of multivibrator 236. A resistor 258 has the upper terminal thereof connected to the positive regulated eleven volts D.C. and also to pin 16 of multivibrator 236; and it has the lower terminal thereof connected to pin 2 of that multivibrator and to the upper terminal of a capacitor 260. The lower terminal of that capacitor, and pins 1, 8 and 15 of multivibrator 236, are grounded. Pins 4 and 6 of that multivibrator are connected together and to the anode of a diode 274, and also to pins 10 and 12 of a multivibrator 262. A fixed resistor 263 and an adjustable resistor 264 are connected in series between pins 13 and 14 of multivibrator 262; and pin 13 is connected to the positive regulated eleven volts D.C. while pin 14 is connected to the upper terminal of a capacitor 266 which has the lower terminal thereof grounded. Pins 9 and 11 of that multivibrator are connected together and, via a resistor 268, to the base of a PNP transistor 270 and, via a resistor 272, to the positive regulated eleven volts D.C. The emitter of transistor 270 is connected to that positive regulated eleven volts D.C., and the collector of that transistor is connected, via pin 5 of connector 309, to a suitable audio indicator, not shown, of standard and usual design.

The cathode of diode 274 is connected to the input of an inverter 276 which has its output connected to the cathode of diode 278. The cathode of diode 274 also is connected to the base of an NPN transistor 290 by a resistor 286, and is connected to the cathode of a diode 284. A resistor 288 is connected between the base and the grounded emitter of transistor 290; and the collector of that transistor is connected to the upper terminals of a relay coil 292 and to the anode of a diode 294. The cathode of that diode and the lower terminal of that relay coil are connected to the positive terminal of the twelve volt battery by pin 4 of connector 309.

A resistor 229 and LEDs 56, 58 and 108 are connected between the positive regulated eleven volts D.C. and ground by pins 3 and 4 of connector 227. A resistor 280 is connected between ground and the emitter of phototransistor 110; and the input of an inverter 282 is connected to that emitter while the output of that inverter is connected to the anode of diode 284. The collector of transistor 110 is connected to the positive regulated eleven volts D.C. Pin 2 of connector 309 connects one terminal of the stacker motor 122 to ground; and pin 1 of that connector connects the other terminal of that motor to a movable relay contact 296. One fixed relay contact 296 is grounded, while the other fixed relay contact 296 is connected to the positive terminal of the twelve volt battery by pin 4 of connector 309.

Suspending Cash Box From Bill-Accepting Unit:

Whenever the cash box 140 is empty and is to be suspended from the bill-accepting unit 50, the closure 200 will be in the position shown by FIGS. 2, 3, 6, 8, 9 and 11. In that position, the latching faces of the latches 186 and 192 will be up in the recesses 218 in the front section 212 of closure 200, and the convex upper portions of those latches will abut the lower edges of the inner ends of those recesses. The reduced-height side edges 204 and 214, respectively, of the sections 202 and 212 of closure 200 will be overlain by the horizontally-directed flanges 144 and 152 and will be underlain by the angle irons 148 and 156. The rear edge of the section 202 will be in register with the rear face of the rear wall 162 of the cash box 140; and the front of the section 212 will extend a short distance forwardly of the front wall of the housing of the bill-accepting unit 50. At such time, the closure 200 will completely close the top of the cash box 140, and will thereby prevent the insertion of any object into, through or around that closure.

To suspend the cash box 140 from the bill-accepting unit 50, that cash box will have the pins 146 and 154 thereon moved or hooked into position beneath the entrances 136 and 138 in the lower surfaces of the elongated blocks 78 and 82. Thereafter, the rear of the cash box will be moved upwardly and rearwardly to cause the pins 146 and 154 to pass upwardly through those entrances and be lodged within the notches 134 and 135. At this time, the distance between the rear face of pin 154 and the front end of the right-hand reduced-height side edge 214 of section 212 will be less than the distance between the rear end of notch 135 and the rear end 86 of the lower part of the channel-like portion 83 of block 82. Similarly, the distance between the rear face of pin 146 and the front end of the left-hand reduced-height side edge 214 of section 212 will be less than the distance between the rear end of notch 134 and the rear end of the lower part of the channel-like portion 79 of block 78. Consequently, while the pins 146 and 154 are held at the rear ends of the notches 134 and 135, the front of the cash box 140 can be raised upwardly until the reducedheight side edges 214 of the section 212 are raised up into register with the slots 80 and 84 in the channel-like portions 79 and 83. Thereupon, an outwardly-directed force will be applied to the rear surface of tab 216 to pull the closure 200 outwardly relative to the cash box 140; and the slots 80 and 84 in channels 79 and 83 will permit the reduced-height side edges 214 and 204 to pass through them, whereby the channels act as retaining means for the closure. The outward movement of the closure 200 will continue until the rear edge of recess 210 in the undersurface of section 202 of that closure engages, and is stopped by, the abutment 176, as indicated particularly by FIG. 12. During the outward movement of closure 200, the recesses 218 will force the latches 186 and 192 to rotate in the clockwise direction in FIG. 9 to the position indicated by FIG. 23 wherein the latching faces of those latches are below the levels of the lower surfaces of the reduced-height side edges 214 and 204. As the recesses 218 in the under surface of closure 200 move outwardly beyond the latches 186 and 192, the notches 220 and 222 will successively move into register with, and then outwardly beyond, those latches. Although the springs 188 and 194 will bias the latching faces on those latches for movement upwardly toward those notches, the convex upper edges on those latches will be continuously engaged by various portions of the under surfaces of the reduced-height side edges 214 adjacent those notches and hence will keep those latching faces from moving upwardly into any of the notches 220 and 222. However, at the end of the outward movement of closure 200, the recesses 206 will be in register with the latches 186 and 192; and the springs 188 and 194 will then rotate those latches to the positions indicated by FIG. 10. Also, at the end of the outward movement of closure 200, all of the length of the front section 212 will be disposed forwardly of the front ends of the channel-like portions 79 and 83; and hence that section can be rotated downwardly to the position shown by FIGS. 1, 4, 5, 7, 10, 12 and 26. At such time, the rear of the section 202 of closure 200 will be disposed forwardly of the front end of the bill-supporting plate 158, as shown by FIG. 26; and hence that section will coact with the rear wall 88 of the housing of the bill-accepting unit 50 and with the flanges 144 and 152 to define an opening toward which a bill can be moved by the rollers 64 and 70, and through which it can be pushed by the pusher plate 90. Because the section 212 can be rotated down to a position close to the front of the cash box 140, the front-to-rear dimensions of the protective enclosure for that cash box and for the bill-accepting unit 50 need not be much larger than the front-to-rear dimensions of the cash box 140, the side-to-side dimensions of that protective enclosure need not be much wider than the side-to-side dimensions of the housing for the bill-accepting unit 40, and the height of that protective enclosure need not be much greater than the distance from the top of that bill-accepting unit to the bottom of that cash box. However, the inner surface of the bottom of that protective enclosure must be spaced below the level of the lower surfaces of the elongated blocks 78 and 82 a distance which is great enough to enable the cash box 140 to be moved horizontally within that protective enclosure to a position wherein the pins 146 and 154 can be disposed in register with the entrances 136 and 138 in the lower surfaces of those elongated blocks. That protective enclosure will be made of sturdy metal, and it will be provided with a suitable lock, so that unauthorized persons will be unable to reach the cash box after that cash box has been suspended from the bill-accepting unit 50. Suitable mountings, not shown, of standard and usual design, will be provided within the protective enclosure to hold the bill-accepting unit 50 fixed within that protective enclosure.

Figure 9:
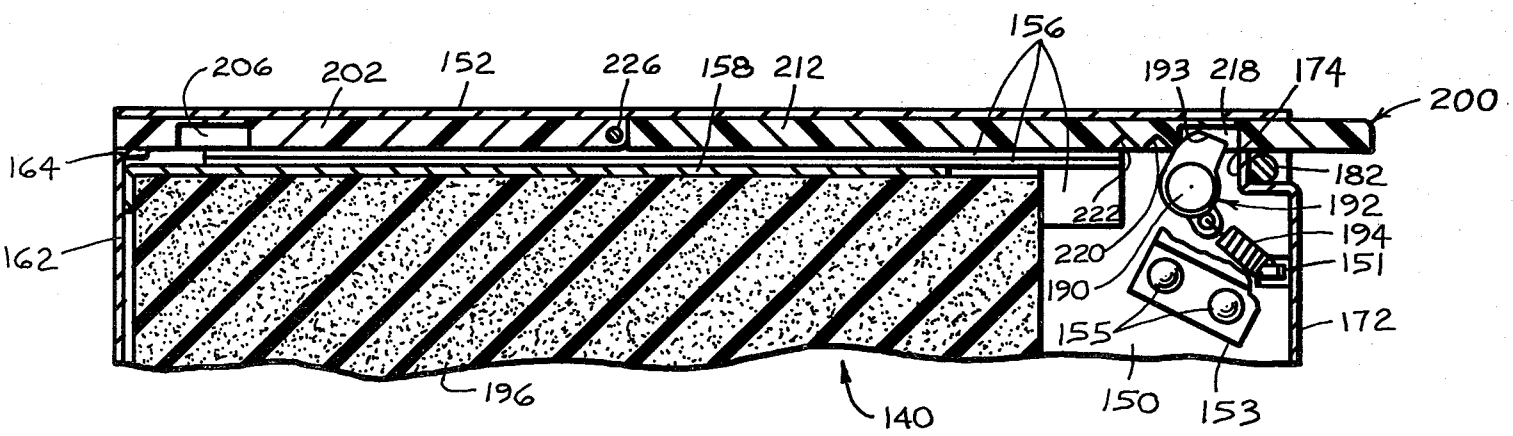
FIG. 9 is a sectional view, on the scale of FIG. 8, which is taken along the plane indicated by the line 9—9 in FIG. 3.
Figure 10:
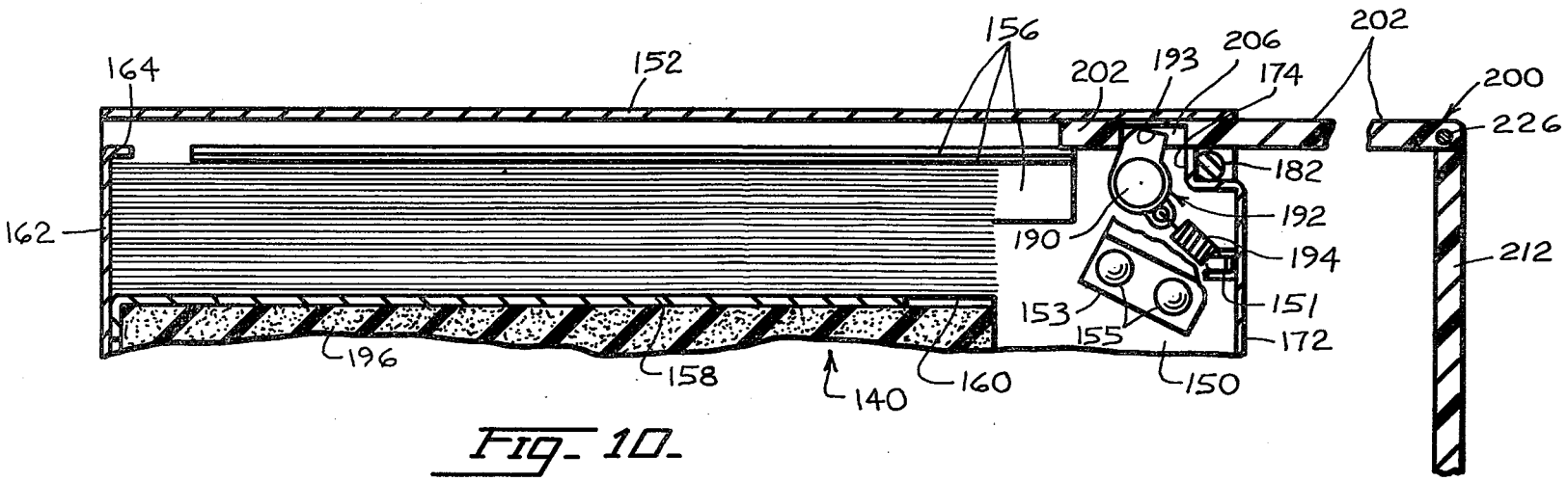
FIG. 10 is a sectional view, on the scale of FIG. 8, which is taken along the plane indicated by the line 10—10 in FIG. 5.
Figure 11:
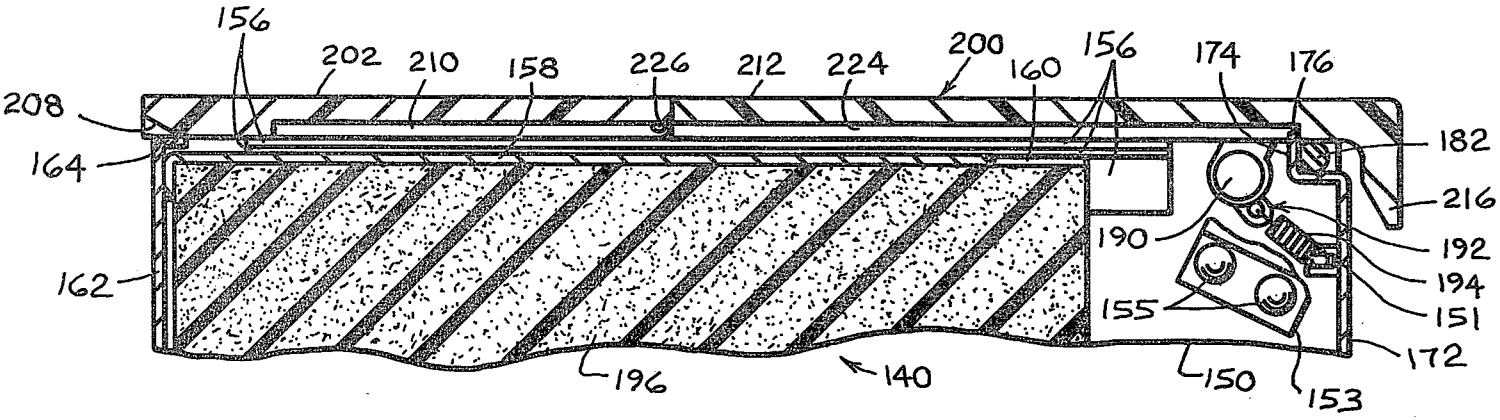
FIG. 11 is a sectional view, on the scale of FIG. 8, which is taken along the plane indicated by the line 11—11 in FIG. 6.
Figure 12:
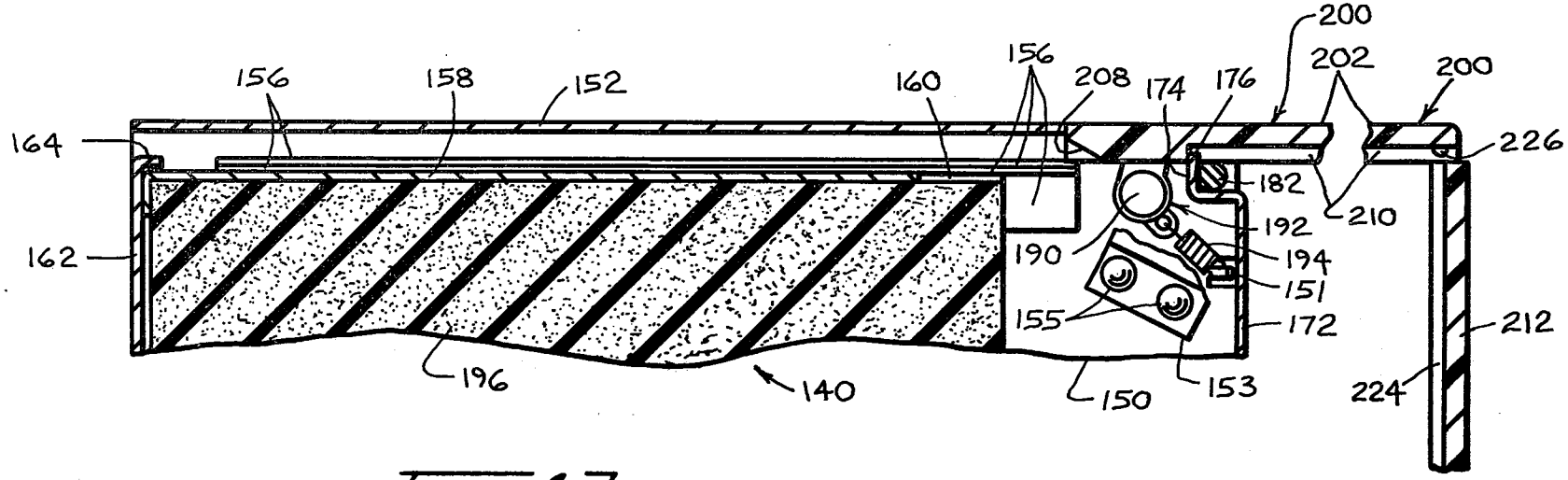
FIG. 12 is a sectional view, on the scale of FIG. 8, which is taken along the plane indicated by the line 12—12 in FIG. 7.

The closure 200 will usually be moved outwardly in unidirectional and uninterrupted fashion from the position of FIG. 9 to the position of FIG. 10 wherein the recesses 206 are in register with the latches 186 and 192. However if, for any reason, that closure were to be shifted back and forth intermediate the position of FIG. 9 and a position to the left of FIG. 10, the latches 186 and 192 would continue to remain in the positions indicated by FIG. 23—and hence would permit such shifting of that closure. Also, those latches would subsequently permit that closure to be moved to the position of FIG. 10. Once the closure 200 has been moved to the position of FIG. 10 and the front section 212 has been rotated downwardly toward the front wall of cash box 140, the protective enclosure for the bill-accepting unit 50 and the cash box 140 will be closed and locked. That protective enclosure will then remain closed and locked until that bill-accepting unit has accepted and stacked a number of bills.

Acceptance And Stacking of Bills:

Each bill 130 will be placed on platform 54 and have its leading edge pushed far enough inwardly through slot 52 to intercept the light from the LED 56. The phototransistor 62 normally is in a conductive state, but it will become nonconductive when a bill intercepts the light from LED 56; and the resulting logic "1" at the collector of that phototransistor will (a) tend to forward-bias diode 278, (b) cause inverter 234 to apply a logic "0" to clock pin 3 of multivibrator 236, and (c) cause inverters 234 and 242 to apply a "1" to the base of transistor 246. The diode 278 will not become forward-biased at this time because inverter 276 will provide a "1" at the cathode of that diode; and the "0" at pin 3 will inhibit any change in the normal logic "0" at output pin 6 of multivibrator 236. However, the "1" at the base of transistor 246 will render that transistor conductive; and, thereupon, current will flow from the positive terminal of the twelve volt battery via pin 4 of connector 309, the three junctions above capacitor 308, pin 7 of connector 227, bill-moving motor 124, pin 6 of connector 227, and the collector-emitter circuit of transistor 246 to ground. The resulting energization of that motor and rotation of rollers 64 and 70 will pull the leading edge of bill 130 far enough inwardly to intercept the light which LED 58 supplies to the phototransistor 60, thereby rendering that phototransistor non-conductive. The resulting "1" at the collector of that phototransistor will cause inverters 254 and 256 to apply a "1" to pin 5 of multivibrator 236; but pin 6 will continue to provide a "0" because that multivibrator responds only to a falling signal at pin 5 and also because the continuing "0" at pin 3 will continue to inhibit any change at pin 6.

The rollers 64 and 70 will continue to move bill 130 inwardly and will cause that bill to start following the path which is indicated by dotted lines 132 in FIG. 26. When the trailing edge of that bill has been moved far enough inwardly to enable light from LED 56 to again render phototransistor 62 conductive, the "0" at the collector of that phototransistor will (a) cause inverter 234 to remove the inhibiting "0" from clock pin 3, (b) remove the forward-biasing "1" at the anode of diode 278, and (c) cause inverters 234 and 242 to permit transistor 246—and hence bill-moving motor 124—to become inactive. However, the momentum of the output shaft of that motor, of the gearing between that output shaft and the gear 68, of the shafts 66 and 72, and of the rollers 64 and 70 will cause those rollers to move the bill 130 far enough inwardly to free the trailing edge of that bill and cause that bill to follow the path 132. As the trailing edge of that bill again permits light from LED 58 to reach phototransistor 60, inverters 254 and 256 will cause the "1" at pin 5 of multivibrator 236 to become a "0". Because an inhibiting "0" no longer appears at clock input 3, the change from "1" to "0" at pin 5 will cause a "1" to appear at output pin 6; and that "1" will remain for about two hundred and seventy milliseconds (270 ms). That "1" will (a) cause diode 274 and resistor 286 to apply a "1" to the base of transistor 290 and thereby permit current to flow from the positive terminal of the twelve volt battery via pin 4 of connector 309, the three junctions above capacitor 308, relay coil 292, and transistor 290 to ground to energize that relay coil, (b) apply a "1" to pin 4 to prevent re-triggering of that multivibrator throughout that two hundred and seventy milliseconds (270 ms), (c) cause diode 274 and inverter 276 to apply a "0" to the cathode of diode 278 and thereby keep a "1" from being applied to the input of inverter 234 even if a further bill 130 is caused to intercept the light from LED 56 during that two hundred and seventy milliseconds (270 ms), and (d) cause multivibrator 262 to render transistor 270 conductive and thereby enable the audio indicator, not shown, to indicate that the stacker motor 122 is being energized. As relay coil 292 becomes energized, current will flow from the positive terminal of the twelve volt battery via pin 4 of connector 309, the two junctions above capacitor 308, the left-hand and movable contacts 296, pin 1 of connector 309, stacker motor 122, pin 2 of that connector, and a junction and pin 3 of that connector to the negative terminal of that battery. Thereupon, that motor will rotate the shaft 120 in FIG. 26 and cause the crank arm 116 to move from its upper position toward its lower position. Pin 118 will act through link 114 and pivot 112 to force the U-shaped bracket 92, and hence the pusher plate 90, downwardly. The offset plate 96 will then move the slot 100 therein out of register with LED 108; and the resulting logic "0" at the emitter of phototransistor 110 will (a) cause inverter 282, diode 284 and resistor 286 to maintain a "1" at the base of transistor 290—with continued energization of relay coil 292 and stacker motor 122 and (b) cause inverter 282, diode 284 and inverter 276 to maintain a "0" at the cathode of diode 278, as long as the offset plate 96 is below the position of FIG. 26. As a result, that plate coacts with LED 108 and phototransistor 110 to prevent the starting of bill-accepting motor 124 and will rotate shaft 120 until the crank arm 116 has made one complete revolution. During that revolution, the bottom of pusher plate 90 will engage the bill, which moved along path 132 and came to rest atop flanges 144 and 152, and will force the central area of that bill downwardly below the level of those flanges 144 and 152 and also below the level of the angle irons 148 and 156. Also, that pusher plate will force the bill-supporting plate 158 far enough downwardly below the level of those angle irons to enable the elongated edges of the bill to pass below those angle irons and attempt to assume the planar state which the central area of that bill will be given by the pusher plate 90 and bill-supporting plate 158.

As the crank arm 116 moves past its lower position and starts back up to the upper position of FIG. 26, pusher plate 90 will be moved upwardly and will permit the resilient block 196 to move the bill-supporting plate 158 upwardly toward the position of FIG. 8. That resilient block 196 will force the bill-supporting plate upwardly until the angle irons 148 and 156 intercept the elongated edges of the bill, and thereby prevent further upward movement of that bill-supporting plate. At such time, the bill will be firmly held in position as the beginning of, or as a part of, a paper currency stack.

A further bill 130 can be placed on the platform 54 and then moved inwardly through slot 52 to initiate a further bill-accepting and bill-stacking cycle as soon as the slot 100 in plate 96 has moved back into register with LED 108 and phototransistor 110. At such time, the logic "1" at the emitter of that phototransistor will cause inverter 282, diode 284 and inverter 276 to restore the "1" at the cathode of diode 278 and thereby back-bias that diode so the interception of light from LED 56—by the leading edge of the further bill—can enable inverters 234 and 242 to again render transistor 246 conductive and again energize bill-moving motor 124.

Removing Cash Box:

Where the bill-accepting unit 50 is mounted within a vehicle such as a bus or streetcar, the capacity of the cash box 140 will be greater than the maximum number of bills which can be inserted by patrons from the time that vehicle leaves the garage until it subsequently returns to that garage. At the time that vehicle returns to the garage, the protective enclosure for the bill-accepting unit 50 will be opened by an authorized person. The reduced-height side edges 204 of the rear section 202 will be lodged within the slots 80 and 84 in the channel-like portions 79 and 83, and hence will prevent separation of the cash box 140 from the bill-accepting unit. Also, the pins 146 and 154 will be held within the notches 134 and 135 in the rear portions of the elongated blocks 78 and 82 and also will prevent separation of that cash box from that bill-accepting unit. This is important, because it will keep that cash box from being separated from that bill-accepting unit while the closure 200 is displaced from its closed position; and hence a person can not remove that cash box from that bill-accepting unit and reach down through the upper end of that cash box to extract one or more of the stacked bills within that cash box.

To separate the cash box 140 from the bill-accepting unit 50, the closure 200 must have the front section 212 thereof rotated upwardly about the hinge pins 226 until that front section approaches the plane which is defined by the flanges 144 and 152. That front section must then be pushed inwardly until the forward ends of the reduced-height side edges 214 of that section are disposed inwardly of the rear edge 86 of the lower part of channel-like portion 83 and of the corresponding rear edge of the lower part of the channel-like portion 79. At such time, the forward end of the cash box 140 can be moved downwardly until the reduced-height side edges 214 of the front section 212 are below the bottoms of the channel-like portions 79 and 83; and, thereupon, that forward end can be moved forwardly beneath those channel-like portions until the pins 146 and 154 are freed from the notches 134 and 135. The cash box 140 can then be separated from the bill-accepting unit 50; and the closure 200 will fully protect the contents of that cash box.

As the front section 212 of the closure 200 was rotated upwardly toward the plane which is defined by the flanges 144 and 152, and was then moved inwardly relative to those flanges, the forward ends of the recesses 206 in the undersurfaces of the reduced-height side edges 204 of the section 202 engaged the forward ends of the latches 186 and 192 and rotated those latches in the counterclockwise direction from the position shown by FIG. 10. As the forward ends of the recesses 206 moved inwardly past the locking faces of those latches, the undersurfaces of the reduced-height side edges 204 of the section 202 continued to hold those latches in their counterclockwise positions. When the reduced-height side edges 214 of the section 212 moved into the spaces defined by flanges 144 and 152 and by angle irons 148 and 156, the undersurfaces of those side edges continued to hold the latches 186 and 192 in their counterclockwise positions.

As the notches 222 moved into register with the latches 186 and 192, the springs 188 and 194 rotated those latches in the clockwise direction and caused the locking face 193, and the corresponding locking face on the latch 186, to move into those notches. Those locking faces coacted with those notches to make certain that the inward movement of the closure 200 was not halted and then succeeded by an outward movement which could expose the stacked bills within the cash box 140. The front ends of the reduced-height side edges 214 of the section 212 were still lodged within the slots 80 and 84 in the channel-like portions 79 and 83; and hence that section and the pins 134 and 135 continued to prevent separation of the cash box from the bill-accepting unit 50.

Further inward pressure on the finger-receiving tab 216 caused the outer faces of the notches 222 to act as inclined planes, and again forced the latches 186 and 192 to rotate to their counterclockwise positions—wherein the latching surfaces thereof are below the level of the under-surfaces of the reduced-height side edges 214 of section 212. As the notches 220 moved into register with the latches 186 and 192, the springs 188 and 194 again rotated the latches 186 and 192 in the clockwise direction and disposed the latching face 193, and the corresponding latching face on latch 186, within those notches. Those latching faces then coacted with those notches to prevent opening movement of the closure 200. At this time, the forward end of the recess 224 in the undersurface of section 212 will be in engagement with the abutment 176 on the inwardly-offset flange 174 on the door 172; and hence the closure 200 can not be pushed inwardly any further. The front ends of the reduced-height side edges 214 of the section 212 will be disposed rearwardly of edge 86 and of the corresponding edge on the lower part of channel-like portion 79; and hence the cash box 140 can be separated from the bill-accepting unit 50. Importantly, the closure 200 will be latched in closed position so none of the stacked bills can be removed from that cash box.

The closure 200 will continue to protect the stacked bills therein until the cash box is taken to an area where an authorized person will open it and remove the stacked paper currency therein. To open that cash box, the authorized person will insert a key in the lock 178 and rotate that key to rotate the locking blade 180 above the level of the upper edge 168 of the front 166 of the cash box. Thereupon, the bottom of that door can be pulled forwardly, by application of a suitable force to that key, until that locking blade and the rest of that lock are disposed forwardly of the front 166. Then a downward force can be applied to the door to pull the abutment 176 and the inwardly-offset flange 174 downwardly and away from the elongated rod 182—with consequent freeing of the door 172 from the cash box 140. The authorized person can then reach into the front of that cash box and remove the stacked paper currency.

Figure 13:
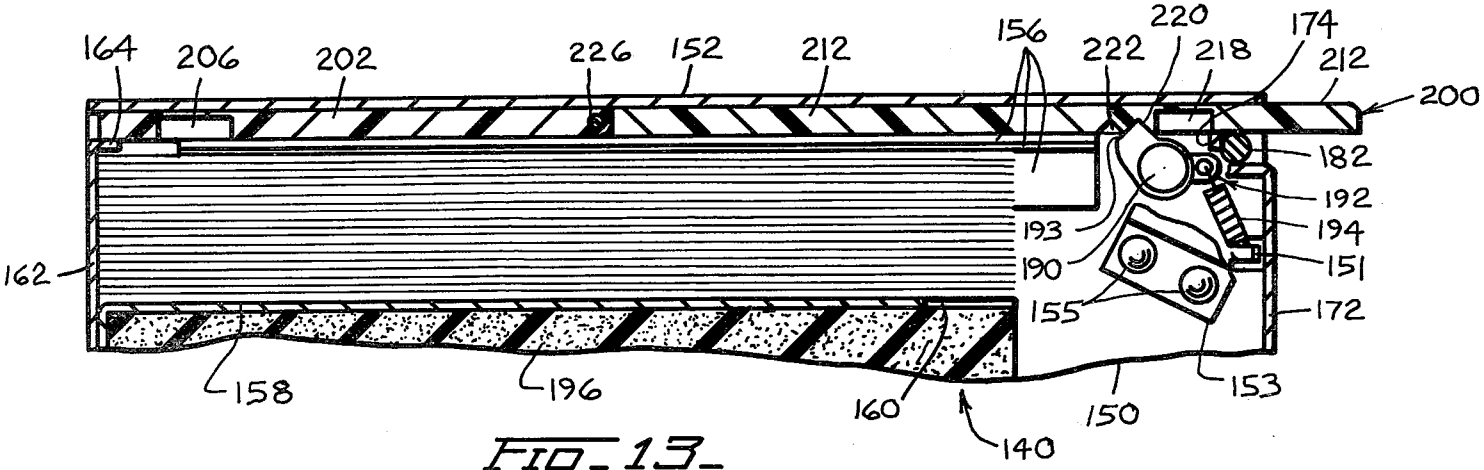
FIG. 13 is a sectional view, on the scale of FIG. 8, which is taken along the plane indicated by the line 13—13 in FIG. 6.
Figure 14:
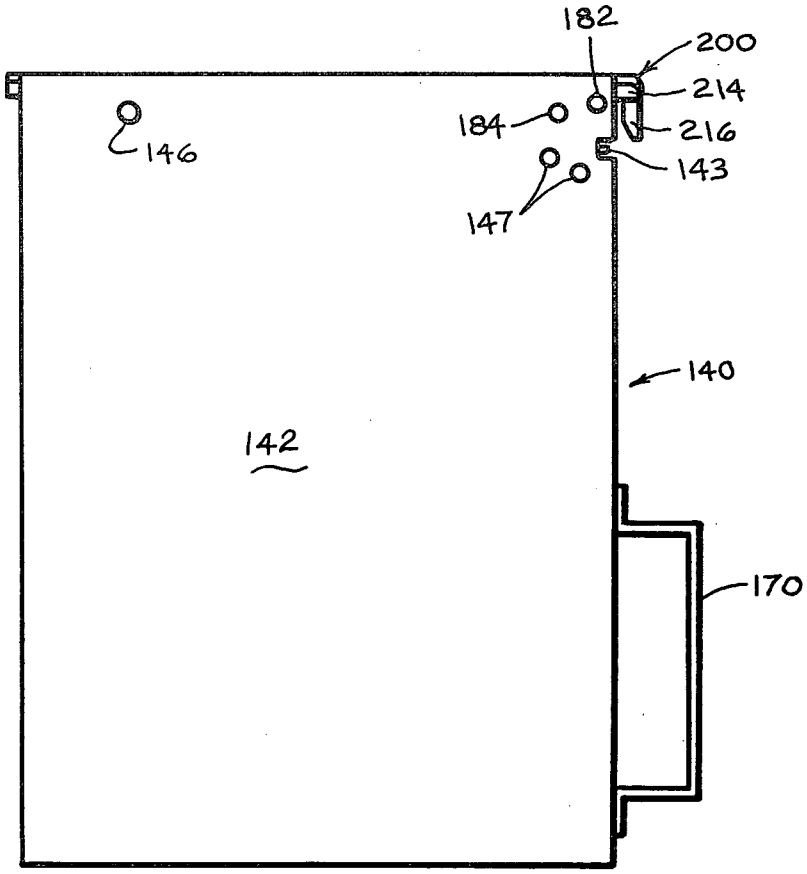
FIG. 14 is a side elevational view, on the scale of FIG. 2, which shows the cash box of FIGS. 1–13 after the door thereof has been removed.
Figure 21:
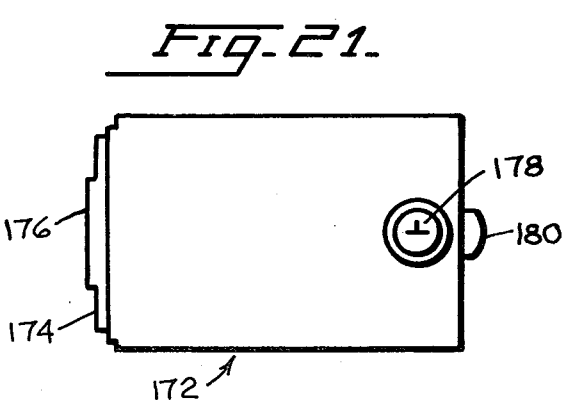
FIG. 21 is an elevational view, on the scale of FIG. 2, of the door for the cash box of FIGS. 1–16 after that door has been rotated so the elongated axis thereof is displaced from a vertical position to a horizontal position.
Figure 22:
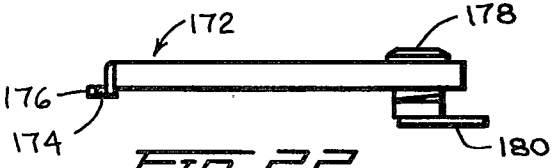
FIG. 22 is a side elevational view of the door of FIG. 21.
Figure 23:
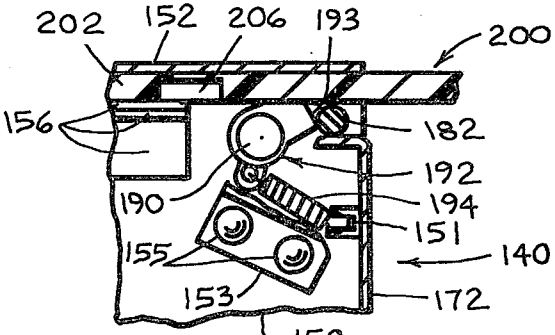
FIG. 23 is a sectional view, on the scale of FIG. 8, which is taken along the plane indicated by the line 10—10 in FIG. 5 and it shows the closure before it reaches the position of FIG. 10.
Figure 17:
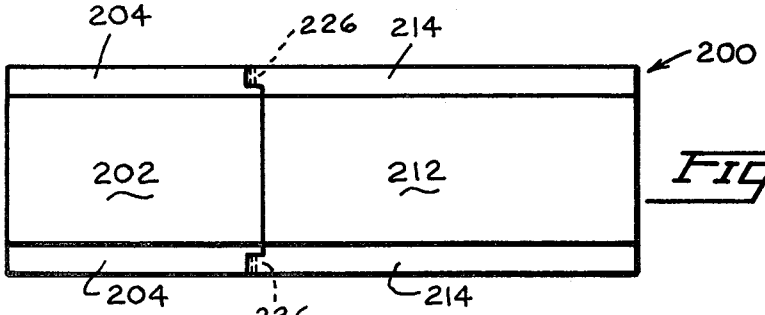
FIG. 17 is a plan view, on the scale of FIG. 2, of the closure for the cash box of FIGS. 1–16.
Figure 18:
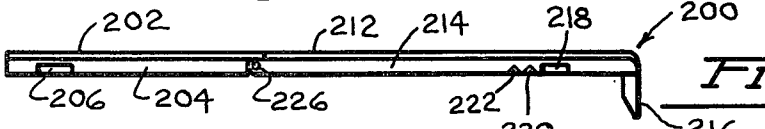
FIG. 18 is an elevational view, on the scale of FIG. 2, of the left-hand side of the closure of FIG. 17.
Figure 19:
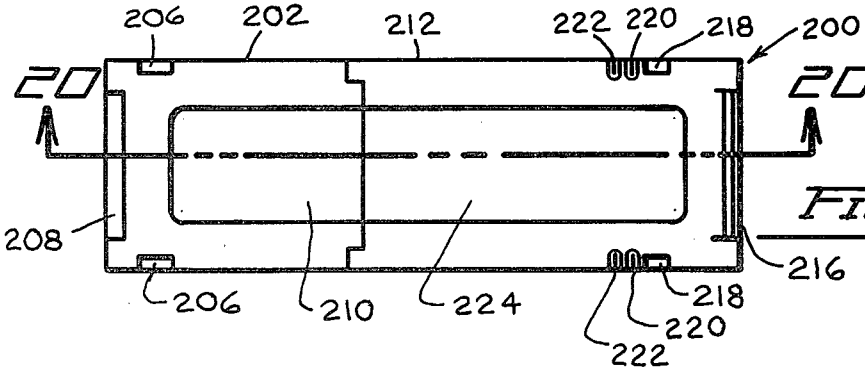
FIG. 19 is a bottom view, on the scale of FIG. 2, of the closure of FIGS. 17 and 18.
Figure 20:
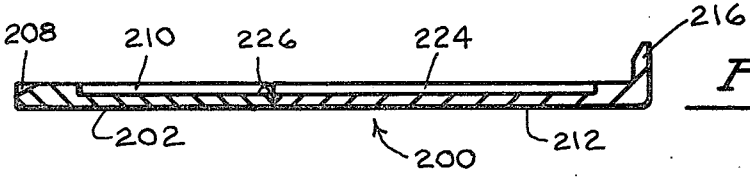
FIG. 20 is a sectional view, on the scale of FIG. 2, which is taken along the plane indicated by the line 20—20 in FIG. 19.

The closure 200 must be freed from the latched position of FIG. 13—to free that closure for subsequent movement to its open position. To free that closure from the latched position of FIG. 13, a further inwardly-directed force will be applied to the finger-receiving tab 216 to cause the recesses 218 to reach the positions indicated by FIG. 16. It will be noted that the closure is further to the left in FIG. 16 than it is in FIG. 9; and it was necessary to move that closure to the position of FIG. 16 to enable the latching face 193, and the corresponding latching face on latch 186, to clear the inner ends of recesses 218 and assume the positions indicated by FIG. 16. At this time, the closure 200 can be pulled forwardly to its open position or, if desired, completely separated from the cash box. With the closure 200 removed, the authorized person can then reach into the front and into the top of that cash box and remove the stacked paper currency.

Figure 16:
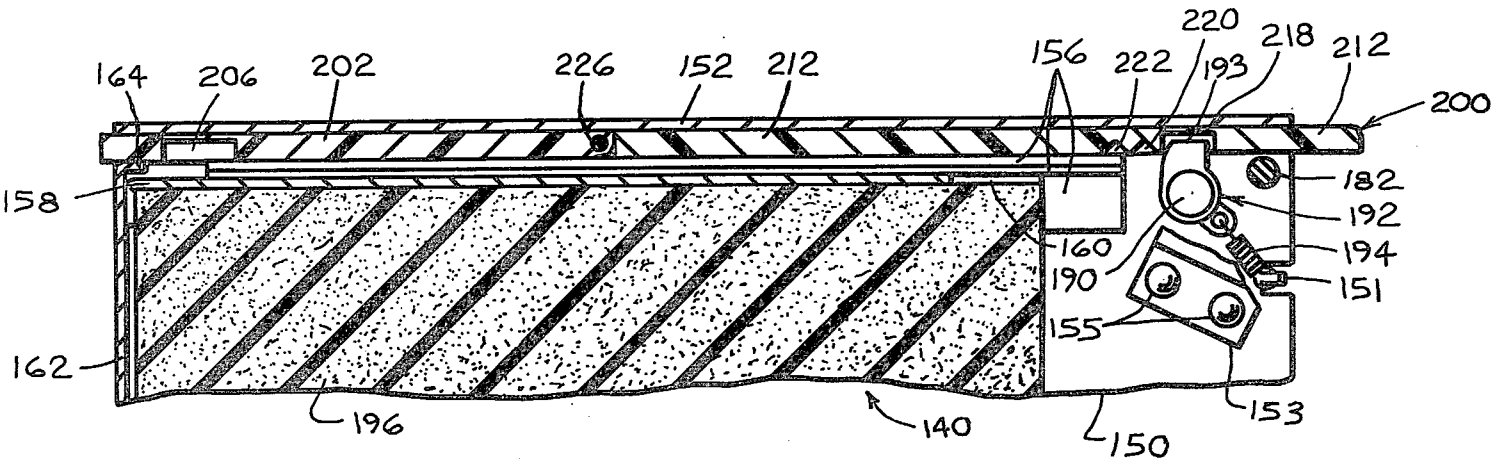
FIG. 16 is a sectional view, on the scale of FIG. 8, which is taken along the broken plane indicated by the broken line 16—16 in FIG. 15.

Readying Cash Box For Further Bill-Stacking Operations:

After the stacked paper currency has been removed from the cash box 140, the closure 200 will be disposed in a position close to that of FIG. 16. The abutment 176, on the inwardly-offset flange 174, will then be moved inwardly through the open upper area of the front of the cash box and moved upwardly behind the rod 182 and into the shallow recess 224 in the undersurface of section 212 of closure 200. At this time, that inwardly-offset flange will abut the inner face of that rod to hold the upper portion of door 172 in assembled relation with the cash box; and then the lock 178 will be actuated to move the locking blade 180 down into locking position inwardly of the front 166 of that cash box. The closure 200 can be left in the position of FIG. 16 or can be moved outwardly to the position of FIG. 9; because, in each of those positions, the forward ends of the reduced-height side edges 214 of section 212 will be closer to the rear surfaces of pins 146 and 154 than the rear edge 86, and its counterpart on the channel-like portion 79, are to the rear ends of notches 134 and 135. Consequently, the cash box 140 can again be suspended from the bill-accepting unit 50 and can thereafter have the closure 200 thereof moved forwardly to permit the acceptance of bills and to lock that cash box in assembled relation with that bill-accepting unit. Cash Box of FIGS. 28–30:

The numeral 330 in FIGS. 28 and 29 generally denotes a second preferred form of cash box that is made in accordance with the principles and teachings of the present invention. That cash box has flanges 144 and 152 which are identical to the similarly-numbered flanges on the cash box 140. Also, the cash box 330 has pins 146 and 154 which are identical to the similarly-numbered pins on the cash box 140. Further, the cash box 330 has angle irons 148 and 156 which are identical to the similarly-numbered angle irons of the cash box 140. Moreover, the cash box 330 has a closure 200—a small portion of the rear of which is shown in FIG. 28—which is identical to the similarly-numbered closure of the cash box 140. In addition, the cash box 330 has a resilient block 196 which is essentially identical to the similarly-numbered resilient block of the cash box 140—the resilient block 196 of the cash box 330 having a horizontal length which is just a fraction of an inch shorter than the horizontal length of the corresponding resilient block for the cash box 140.

The primary difference between the cash box 330 and the cash box 140 resides in the bill-supporting plates for those cash boxes. The bill-supporting plate 158 of the cash box 140 has the configuration of an inverted U, whereas the bill-supporting plate 332 for the cash box 330 is a flat plate, as shown particularly by FIG. 29. Instead of depending upon frictional resistance between itself and the inner surface of one or the other of the side walls of the cash box 140 to hold itself in position within that cash box—as does the bill-supporting plate 158—the bill-supporting plate 332 is provided with a T-shaped inner end 336. A notch 342, which is defined by that T-shaped inner end, accommodates the free edge of a Z-shaped guide 338 which is fixedly secured to the inner face of the rear wall 162 of the cash box 330. A further notch 344, which is defined by that T-shaped inner end, accommodates the free edge of a further Z-shaped guide 340 which is fixedly secured to the inner face of that rear wall. Those two notches are large enough to permit ready vertical movement of the bill-supporting plate 332 relative to the cash box 330; but the T-shaped inner end 336 will coact with the Z-shaped guides 338 and 340 to prevent accidental separation of the bill-supporting plate 332 from the cash box 330—even if a substantial pulling force is applied to that bill-supporting plate. As a result, that bill-supporting plate will remain within the cash box 330 even if a person, accidentally or otherwise, applies a substantial pulling force to that bill-supporting plate as a stack of paper currency is being removed from the cash box 330. Actually, of course, no substantial pulling force need, or should, be applied to the bill-supporting plate 332 as paper currency is being removed from the cash box 330; because an arcuate recess 334 is provided in the front edge of that bill-supporting plate to accommodate a portion of the thumb or a finger of one hand of a person attempting to remove that paper currency. However, even if a substantial pulling force were to be applied to the bill-supporting plate 332, that force could not separate that plate from the cash box 330.

To install the bill-supporting plate 332 within the cash box 330, the resilient block 196 will be compressed to enable that bill-supporting plate to be telescoped inwardly through the open upper portion of the front of that cash box with its upper face inclined to the plane which is defined by the flanges 144 and 152. The inclination of that bill-supporting plate relative to that plane will be great enough to enable the ends of the T-shaped inner end 336 to pass rearwardly between the confronting free edges of the Z-shaped guides 338 and 340. After the T-shaped inner end has been passed rearwardly of the confronting free edges of those guides, the bill-supporting plate 332 will be rotated about its long axis until it is parallel to the plane which is defined by the flanges 144 and 152. Thereupon, the resilient block 196 will be permitted to expand to underlie and support that bill-supporting plate.

The function and operation of the bill-supporting plate 332 will be identical to the function and operation of the bill-supporting plate 158. As a result, the cash boxes 140 and 330 can be used interchangeably and will perform the same functions. However, the bill-supporting plate 332 will be more resistant to separation from the cash box 330 than the bill-supporting plate 158 is from the cash box 140.

Conclusion:

The adjustable resistor 232 of FIG. 27 can be set to permit the inverter 234 to change the normal "1" at the output thereof to a "0" only when the colored engraving of a bill moves between LED 56 and phototransistor 62; and such an arrangement would keep the bill-accepting unit 50 from accepting blank pieces of white paper. If, however, large numbers of passengers recurrently board a vehicle at one or more major stops of that vehicle, or if experience shows that very few passengers fail to insert authentic paper currency, the adjustable resistor 232 could be set to permit the inverter 234 to change the normal "1" at the output thereof to a "0" whenever even a blank piece of paper was moved between LED 56 and phototransistor 62.

If large numbers of passengers used play money or other improper pieces of paper to actuate the bill-accepting unit 50, a paper currency validator could be substituted for that bill-accepting unit. The bill-discharging rollers, or the trailing edges of the bill-discharging belts, of that paper currency validator would be mounted about where the rollers 64 and 70 of the bill-accepting unit 50 are mounted. That paper currency validator would return play money and other improper pieces of paper to the passengers who inserted them, but would cause acceptable bills to follow the path indicated by the numeral 132 in FIG. 26.

When the cash box 140 or 330 is supported from the bill-accepting unit 50, the angle irons 148 and 156 are spaced above the levels of the lower surfaces of the elongated blocks 78 and 82, as indicated by FIG. 26. At such time, the pusher plate 90 can be moved just far enough downwardly, as shown by the dotted-line position of FIG. 26, to force the edges of a bill below the confronting edges of those angle irons. This is desirable, because it will keep that pusher plate from stacking bills within a cash box that is merely set in position below, rather than being suspended from, the bill-accepting unit 50.

Also, if desired, a switch could be provided on the bill-accepting unit 50 which would automatically be in closed position whenever a cash box was suspended from that bill-accepting unit. If that switch was intarposed between pin 4 of connector 309 and the junction above capacitor 308 in FIG. 27, that switch would prevent operation of the bill-accepting unit 50 unless and until the cash box 140 or 330 was suspended from that bill-accepting unit.

In the drawing, the door 172 is shown as constituting an appreciable portion of the front of the cash box 140 and as having the locking member 180 rotatably mounted thereon. Such a door is very desirable; because it permits a person to reach into the front of the cash box and readily remove the stacked currency. However, if a potential user did not desire the convenience of easy removal of stacked currency which is afforded by the door 172, it would be possible to eliminate that door and to have the front of the cash box 140 or 330 extend up to the level of the bottom of the elongated rod 180. In such event, the locking blade 180 could be mounted on the upper portion of the front of the cash box, and that locking blade could then perform the functions which the abutment 176 performs, namely, limiting both the outwardly-directed and the inwardly-directed movement of the closure 200.

The preferred embodiment of the present invention has two notches 220 plus two notches 222 in the undersurface of the front section 212 of the closure 200. The use of those two sets of notches obviates all need of holding close tolerances for the positioning of pins 146 and 154 on the rear portions of the side walls of cash box 140 or 330, for the positioning of the notches 134 and 135 in the elongated blocks 78 and 82, for the forming of the rear end 86 of the lower part of channel-like portion 79 and for the forming of the corresponding rear end of the lower part of channel-like portion 83, and for the lengths of the sections 202 and 212 of closure 200. However, if closer manufacturing tolerances were acceptable, the notches 222 could be eliminated.

The following chart of Values Of Components In Preferred Embodiment Of Invention shows values which have been found to be very useful. However, if desired, other values could be used for various of those components.

VALUES OF COMPONENTS IN PREFERRED EMBODIMENT OF INVENTION

229 - 560 ohms
230 - 47,000 ohms
232 - 1 megohm
234 - one section of a Motorola MC 14049 U B Hex Inverter Buffer
236 - one-half of a Motorola MC 14538B Monostable Multivibrator
238 - 22,000 ohms
240 - 4.7 MFD
242 - one section of a Motorola MC 14049 U B Hex Inverter Buffer
244 - 5600 ohms
246 - T1P 110
250 - 47,000 ohms
252 - 1 megohm

254 - one section of a Motorola MC 14049 U B Hex Inverter Buffer
256 - one section of a Motorola MC 14049 U B Hex Inverter Buffer
258 270,000 ohms
260 - 1 MFD
262 - one-half of a Motorola MC 14538B Monostable Multivibrator
263 - 10,000 ohms
264 - 1 megohm
266 - 1 MFD
268 - 2200 ohms
270 - Motorola MPS-A55
272 - 10,000 ohms
276 - one section of a Motorola MC 14049 U B Hex Inverter Buffer
280 - 10,000 ohms
282 - one section of a Motorola MC 14049 U B Hex Inverter Buffer
286 - 5600 ohms
288 - 2200 ohms
290 - 2N 3859A
12 volt relay coil
298 - 6.8 MFD
300 - 0.01 MFD
302 - 0.1 MFD
304 - IN962 11V Zener
306 - 15 ohms
308 - 0.01 MFD
274, 278, 284 and 294 - 1N914 Diode 56 and 62, 58 and 60 and 108 and 110 -GEH13B1 Opto Switch Whereas the drawing and accompanying description have shown and described two preferred embodiments of the present invention, it should be apparent to those skilled in the art that various changes may be made in the form of the invention without affecting the scope thereof.

What we claim is:

1. Bill handling apparatus comprising a bill-accepting unit;

a bill-receiving container removably secured to the bottom of the bill-accepting unit having an opening at the top through which a bill entered in the bill-accepting unit may be pushed down for flatwise stacking of bills in the container, the bill-accepting unit having means for pushing a bill entered in the unit down into the container, the container having a closure for its top opening movable between a closed position in which it may be locked for precluding unauthorized access to the container and an open position for allowing bills to be pushed down into the container;

the closure in its open position extending outwardly from the container;

and means for releasably locking the container to the bill-accepting unit and precludng its removal from the bill-accepting unit unless the closure is closed including retaining means on the unit engageable by the opened closure where it extends outwardly from the container, the container being applicable to the bottom of the bill-accepting unit with the closure closed, the closure then being adapted to be opened for delivery of bills to the container and for interlocking of the closure where it extends from the container with said retaining means on the bill-accepting unit for locking the container to the bottom of the bill-accepting unit, the container being removable from the bottom of the bill-accepting unit on closing the closure with attendant disengagement of the closure from said retaining means.

2. Bill handing apparatus as set forth in claim 1 wherein the container is generally rectangular in plan, having sides and forward and rearward ends with the sides spaced somewhat greater than the width of a bill for holding the bills endwise in the container, the closure being slidable endwise of the container between its open and closed positions and extending forward from the container at the top of the container when slid to its open position, said retaining means on said bill-accepting unit being located forward of the forward end of the container for engagement by the closure when the closure is slid forward to open position.

3. Bill handling apparatus as set forth in claim 2 wherein the closure comprises slide plate means and said retaining meeans comprises channel means associated with the bill-accepting unit forward of the top of the container in line with the slide plate means for slidably receiving the slide plate means when the latter is slid forward to open position.

4. Bill handling apparatus as set forth in claim 3 wherein the means for releasably locking the container to the bill-accepting unit further comprises means for hooking the container, with the closure closed, to the bill-accepting unit adjacent the rear and top of the container, the container then being movable into position with the top of the container at the bottom of the bill-accepting unit, and the slide plate means then being slidable forward into the channel means.

5. Bill handing apparatus as set forth in claim 3 wherein the slide plate means comprises a rearward section and a forward section pivoted at the forward end of the rearward section, the rearward section sliding into the channel means when the slide plate means is slid forward to open position, and the forward section then being swingable to hang down from the forward end of the rearward section.

6. Bill handling apparatus as set forth in claim 1 having means operable on moving the closure to closed position to remove the container from the bill-accepting means for latching the closure in the closed position, and key-operated means operable after removal of the container from the bill-accepting unit for controlling the opening of the closure.

7. Bill handling apparatus as set forth in claim 6 wherein the key-operated means comprises a second closure for the container having a key-operated lock for locking it to the container.

* * * * *